US008692761B2

(12) United States Patent
Neal

(10) Patent No.: US 8,692,761 B2
(45) Date of Patent: Apr. 8, 2014

(54) APPARATUS AND METHOD FOR MODELING THE LIGHT FIELD OF A LOCAL-DIMMING LED BACKLIGHT FOR AN LCD DISPLAY

(75) Inventor: Greg Neal, Morgan Hill, CA (US)

(73) Assignee: STMicroelectronics, Inc., Coppell, TX (US)

( * ) Notice: Subject to any disclaimer, the term of this patent is extended or adjusted under 35 U.S.C. 154(b) by 91 days.

(21) Appl. No.: 13/456,785

(22) Filed: Apr. 26, 2012

(65) Prior Publication Data

US 2012/0274669 A1 Nov. 1, 2012

Related U.S. Application Data

(60) Provisional application No. 61/479,639, filed on Apr. 27, 2011.

(51) Int. Cl.
*G09G 3/36* (2006.01)

(52) U.S. Cl.
USPC ..... 345/102; 345/690

(58) Field of Classification Search
USPC ..... 345/102, 690, 87, 89, 104, 173
See application file for complete search history.

(56) References Cited

U.S. PATENT DOCUMENTS

| | | | | |
|---|---|---|---|---|
| 5,745,197 | A * | 4/1998 | Leung et al. | 349/77 |
| 2008/0111947 | A1* | 5/2008 | Epstein et al. | 349/63 |
| 2008/0204873 | A1* | 8/2008 | Daniell | 359/463 |
| 2009/0185278 | A1* | 7/2009 | Coyle et al. | 359/625 |
| 2010/0157030 | A1* | 6/2010 | Nayar et al. | 348/54 |

* cited by examiner

*Primary Examiner* — Ricardo L Osorio
(74) *Attorney, Agent, or Firm* — Carter Scholer

(57) ABSTRACT

An apparatus for displaying images. The apparatus comprises: an LCD panel comprising a plurality of pixels for displaying the images; and a backlight comprising a plurality of light sources. Each of the plurality of light sources is associated with one of a plurality of zones and each of the plurality of zones comprises a plurality of grid points. A controller coupled to the LCD panel and the backlight is configured to retrieve contour data associated with each of the plurality of light sources. The contour data is associated with a 3-D contour shape comprising a plurality of facets, each facet associated with at least one of the plurality of grids. The controller is configured to determine a brightness level of at least one pixel in a first grid based on a slope value associated with a first facet associated with the first grid.

20 Claims, 15 Drawing Sheets

| | |
|---|---|
| ActYGrid[7:0] | The frame Y Grid when this entry is processed. |
| FstXZone[12:8] | The first selected Zone. |
| FstYZone[16:13] | The first selected Zone. |
| NumXZones[21:17] | The number of sequentially numbered X Zones selected. |

ACTIVE ZONES TABLE 805

FIGURE 10

| | |
|---|---|
| ZoneType[7:0] | Selects the first entry in the Zone types table to be applied to this Zone. |
| NumSrcs[12:8] | The number of Sources in this Zone – 1. |
| ZoneXPos[21:13] | The horizontal position of the center of this Zone within the frame. The unit of measure is Grids. The top left corner of the active area of the frame is position 0, 0. Value must be positive. |
| ZoneYPos[29:22] | The vertical position of the center of this Zone within the frame. The unit of measure is Grids. The top left corner of the active area of the frame is position 0, 0. Value must be positive. |
| ZoneOrnt[31:30] | The orientation of this Zone.<br>Bit0 = 1, horizontally flipped.<br>Bit1 = 1, vertically flipped. |
| FstSrc[43:32] | The number of the first Source that makes up this Zone. |

ZONE TABLE 825

FIGURE 11

| | |
|---|---|
| SrcXPos[9:0] | The horizontal starting position of this Source within this Zone. The unit of measure is Grids. The center of the Zone is assumed to be position 0, 0. Value is signed. |
| SrcYPos[18:10] | The vertical starting position of this Source within this Zone. The unit of measure is Grids. The center of the Zone is assumed to be position 0, 0. Value is signed. |
| SrcOrnt[21:19] | The orientation, and symmetry of this Source within this Zone.<br>000 = normal.<br>001 = horizontally flipped.<br>010 = vertically flipped.<br>011 = horizontally, and vertically flipped.<br>100 = horizontally symmetrical, no flip.<br>101 = horizontally symmetrical, vertically flipped.<br>110 = vertically symmetrical, no flip.<br>111 = vertically symmetrical, horizontally flipped. |
| FstContrIdx[32:22] | Selects the first entry for this Source in the contour index table. |

ZONE TYPES TABLE 820

FIGURE 12

| | |
|---|---|
| FstVrtx[12:0] | Selects the first Vertex used for this Y Grid of this Source. |
| NumVrtxs[19:13] | The number of Vertices in this Y Grid of this Source. A value of 0 indicates that there are no Vertices. |

CONTOUR INDEX TABLE 845

FIGURE 13

| | |
|---|---|
| HozGap0[4:0] | Selects one of a number of horizontal gaps (in Grids) between the previous Vertex and this one. See below. |
| Vertex0[31:5] | The 2s complement, fractional value of this Vertex.<br>Vertex0[23] = sign.<br>Vertex0[22:10] = Integer value.<br>Vertex0[9:0] = Fractional value. |
| HozGap1[36:32] | Selects one of a number of horizontal gaps (in Grids) between the previous Vertex and this one. See below. |
| Vertex1[63:37] | The 2s complement, fractional value of this Vertex.<br>Vertex1[23] = sign.<br>Vertex1[22:10] = Integer value.<br>Vertex1[9:0] = Fractional value. |
| HozGap2[68:64] | Selects one of a number of horizontal gaps (in Grids) between the previous Vertex and this one. See below. |
| Vertex2[95:69] | The 2s complement, fractional value of this Vertex.<br>Vertex2[23] = sign.<br>Vertex2[22:10] = Integer value.<br>Vertex2[9:0] = Fractional value. |
| HozGap3[100:96] | Selects one of a number of horizontal gaps (in Grids) between the previous Vertex and this one. See below. |
| Vertex3[127:101] | The 2s complement, fractional value of this Vertex.<br>Vertex3[23] = sign.<br>Vertex3[22:10] = Integer value.<br>Vertex3[9:0] = Fractional value. |

CONTOUR TABLE 840

FIGURE 14

| HozGap | Gap |
|---|---|
| 0 | 1 |
| 1 | 2 |
| 2 | 3 |
| 3 | 4 |
| 4 | 5 |
| 5 | 6 |
| 6 | 7 |
| 7 | 8 |

| HozGap | Gap |
|---|---|
| 8 | 9 |
| 9 | 10 |
| 10 | 11 |
| 11 | 12 |
| 12 | 13 |
| 13 | 14 |
| 14 | 15 |
| 15 | 16 |

| HozGap | Gap |
|---|---|
| 16 | 18 |
| 17 | 20 |
| 18 | 24 |
| 19 | 32 |
| 20 | 40 |
| 21 | 48 |
| 22 | 56 |
| 23 | 64 |

| HozGap | Gap |
|---|---|
| 24 | 72 |
| 25 | 96 |
| 26 | 112 |
| 27 | 128 |
| 28 | 160 |
| 29 | 192 |
| 30 | 224 |
| 31 | 256 |

TABLE 6

FIGURE 15

APPARATUS AND METHOD FOR MODELING THE LIGHT FIELD OF A LOCAL-DIMMING LED BACKLIGHT FOR AN LCD DISPLAY

CROSS-REFERENCE TO RELATED APPLICATION(S) AND CLAIM OF PRIORITY

The present application is related to U.S. Provisional Patent No. 61/479,639, filed Apr. 27, 2011, entitled "Modeling the Light Field of A Local-Dimming LED Backlight For An LCD Display". Provisional Patent No. 61/479,639 is assigned to the assignee of the present application and is hereby incorporated by reference into the present application as if fully set forth herein. The present application hereby claims priority under 35 U.S.C. §119(e) to U.S. Provisional Patent No. 61/479,639.

The present application is also related to U.S. patent application Ser. No. 12/727,020 filed Mar. 18, 2010, entitled "Method of Modeling the Light Field Created By A Local-Dimming LED Backlight For An LCD Display" and to U.S. patent application Ser. No. 12/780,721, filed May 14, 2010, entitled "System and Method for Controlling a Display Backlight". Application Ser. Nos. 12/727,020 and 12/780,721 are assigned to the assignee of the present application and are hereby incorporated by reference into the present application as if fully set forth herein.

FIELD OF THE INVENTION

The present application relates to backlighting of display devices such as liquid crystal displays (LCDs). More specifically, this application discloses systems, methods, and apparatuses suitable for modeling the light field of a Light-Emitting Diode (LED) array backlight in an LCD display,

BACKGROUND OF THE INVENTION

Liquid crystal displays (LCDs) are increasingly being used for the display device in televisions, personal computers, and much state-of-the-art equipment, such as automotive navigation systems and simulation devices. One particular area where LCDs are increasingly being utilized is flat panel televisions. With the general acceptance of flat panel TV technology, there has been a large marketing and technology war over which technology is best, such as plasma display technology versus LCD display technology. Flat panel televisions are judged on thickness, weight, price, product lifetime, and image quality. Certain display technologies may be better in one area, such as image quality, but worse in another area, such as weight or price.

Typically, the image quality of a particular display technology is one of the most important factors taken into consideration when a buyer purchases a flat panel television. There are many different criteria to judge image quality. Two important criteria are contrast ratio and black-level reproduction. In the past, the contrast ratio and black-level reproduction of plasma displays have been better than those of LCDs and plasmas displays have often been judged to have better image quality reproduction than LCDs.

An image is generated on an LCD by controlling the amount of light that can pass through an LCD material. The light can be provided by a backlight located on one side of the LCD where the image is viewed from the other side of the LCD opposite the backlight. Typically, the LCD material can include a large number of pixels arranged in an array where the pixels can be individually controlled to affect an amount of light that passes through the LCD material. The pixel control can reproduce a desired image.

One limitation of LCDs is that it is difficult to completely turn off a pixel at a particular location like in a cathode ray tube (CRT). In a CRT, the electron beam can almost be completely turned at a particular location to generate a deep black. In an LCD, a typically image includes light and dark pixel areas. When the backlight remains on to light the lighted pixel areas of the image, light can also bleed through the dark pixel areas, which limits the blackness in the dark pixel areas. One approach to improving the black levels in an LCD panel is to block the light that leaks through the LCD panel when a pixel is supposed to display black levels. Light blocking technology is complicated and its success has been limited. Thus, it would be desirable to provide alternative methods and apparatus, in place of or in conjunction with the light blocking technology, that can be used to improve image quality, such as contrast ratio, generated using an LCD display.

SUMMARY OF THE INVENTION

An apparatus is provided for displaying images. In an advantageous embodiment, the apparatus comprises: 1) an LCD panel comprising a plurality of pixels for displaying the images; 2) a backlight comprising a plurality of light sources, wherein each of the plurality of light sources is associated with one of a plurality of zones and each of the plurality of zones comprises a plurality of grid points; and 3) a controller coupled to the LCD panel and the backlight configured to retrieve contour data associated with each of the plurality of light sources. The contour data is associated with a 3-D contour shape comprising a plurality of facets, each facet associated with at least one of the plurality of grids. The controller is configured to determine a brightness level of at least one pixel in a first grid based on a slope value associated with a first facet associated with the first grid.

An integrated circuit is provided for use with an LCD panel and a backlight comprising a plurality of light sources, where each of the plurality of light sources is associated with one of a plurality of zones and each of the plurality of zones comprises a plurality of grid points. The integrated circuit is configured to retrieve contour data associated with each of the plurality of light sources. The contour data is associated with a 3-D contour shape comprising a plurality of facets, each facet associated with at least one of a plurality of grids. The integrated circuit is configured to determine a brightness level of at least one pixel in a first grid based on a slope value associated with a first facet associated with the first grid.

A method is provided for use with an LCD panel. The method adjusts lighting levels of a backlight of the LCD panel, wherein the backlight comprises a plurality of light sources, each of the plurality of light sources associated with one of a plurality of zones and each of the plurality of zones comprising a plurality of grid points. In one embodiment, the method comprises: 1) retrieving contour data associated with each of the plurality of light sources, wherein the contour data is associated with a 3-D contour shape comprising a plurality of facets, each facet associated with at least one of a plurality of grids; and 2) determining a brightness level of at least one pixel in a first grid based on a slope value associated with a first facet associated with the first grid.

Before undertaking the Detailed Description below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIGS. 10-15 illustrate tables used in a grid brightness calculation architecture and method in accordance with the described embodiments.

DETAILED DESCRIPTION

Figure 1A:
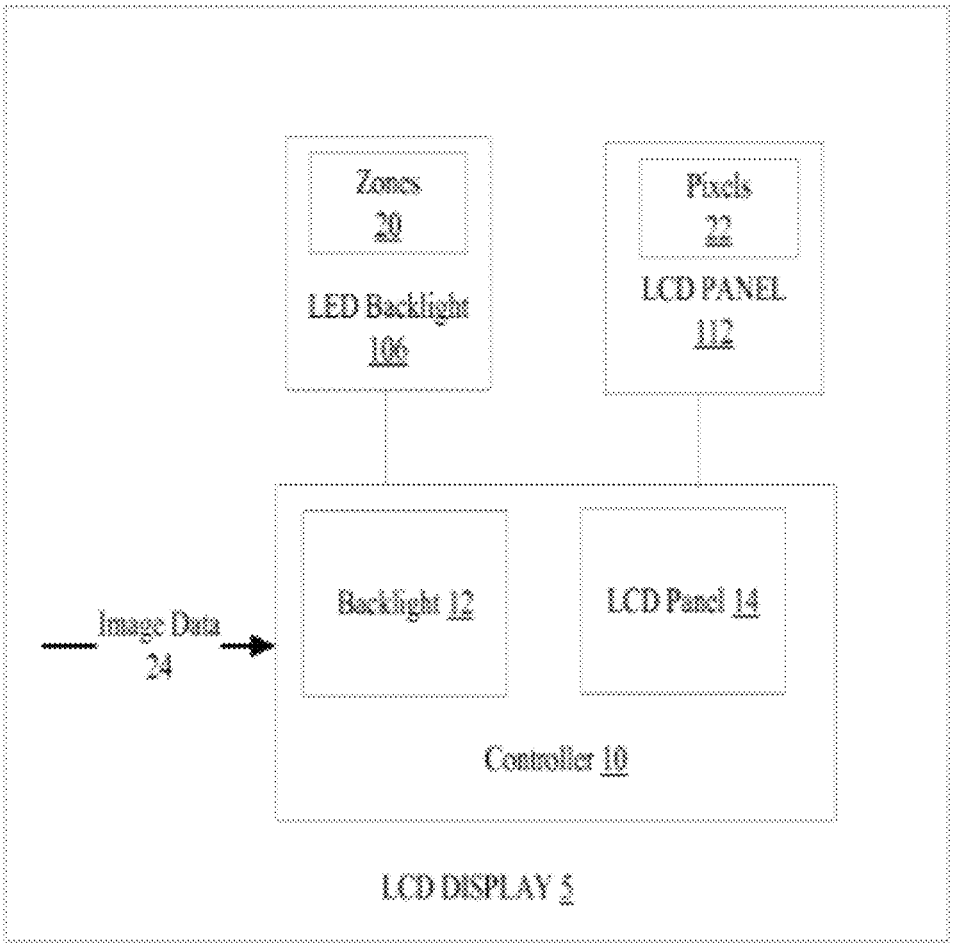
FIG. 1A illustrates a block diagram of a LCD display in accordance with the described embodiments.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged LED display with LED backlight.

The embodiments described herein relate to methods and apparatus for improving contrast ratio and providing darker black regions in an LCD display. The LCD display can include an LCD panel, a backlight and a controller (e.g., see FIG. 1A). The backlight can include an array of LEDs arranged in zones. The LCD panel can include a number of pixels that are illuminated by the backlight to display an image. The pixels in the LCD panel and the zones in the backlight can be controlled by the controller (see FIGS. 3 and 6).

The controller can be configured to selectively dim or turn-off LEDs in one or more zones of the backlight (see FIGS. 1A-C and 3). The dimming can reduce light bleed associated with pixels in the display panel. The reduced light bleed can improve the contrast ratio and provide darker black regions when an image displayed on the LCD display is viewed. Each zone of the backlight can be associated with a portion of the LCD panel (see FIGS. 1B, 1C and 2). The determination of whether to dim a zone can be based upon an analysis of image data to be displayed in a portion of the LCD panel associated with each zone (see FIGS. 2, 3 and 4).

When one or more zones of the backlight are dimmed, the distribution of light provided to the LCD panel is altered. The changed light distribution can affect the illumination of each pixel of the LCD panel (see FIGS. 1A and 1B). Without correction, the changed light distribution from dimming one or more zones of the backlight can lead to portions of an image displayed on the LCD panel appearing brighter in some areas relative to other areas because some areas of the LCD panel receive more light from the backlight than other areas. To reduce this effect, the light transmitted by the individual pixels of the LCD panel can be adjusted in real-time based upon a particular setting of the backlight. For instance, when a portion of the LCD panel receives less light because a portion of the backlight has been dimmed, individual pixels proximate to this region can be darkened or brightened to allow more light to be transmitted through the LCD panel. The adjustment of the individual pixels to account for changing light distributions emitted from the backlight can be referred to as a pixel correction factor. The controller can be configured to perform this calculation (see FIG. 3).

The determination of the pixel correction factor can involve determining the light distribution across the display panel at each pixel location on the display panel. This calculation can be numerically intensive because each zone contributes light to each pixel location. In one embodiment, to reduce the number of required calculations, the calculations can be performed on a grid that is coarser than the pixel resolution of the LCD panel (see FIGS. 2 and 3). In a particular embodiment, the zones of the backlight may be driven asynchronously. That is, the light setting in each zone can be updated in different zones at different times, which can affect the light distribution provided by the display panel. The determination of the light distribution across the LCD panel can be modified to account for asynchronous updates of the light setting in each zone (see FIG. 5).

FIG. 1A illustrates a block diagram of a LCD display 5 in accordance with the described embodiments. The LCD display 5 can include a controller 10, an LED backlight 106 and an LCD panel 112. The LED backlight 106 can include a number of LED arranged in zones 20. Each zone can include one or more LEDs. The LEDs in each zone can be individually controlled to allow an amount of light emitted from each zone to be varied from zone to zone. The backlight portion 12 of controller 10 can be used to determine light levels for each zone.

The LED backlight 106 can illuminate the LCD panel 112. The LCD panel 112 can include a number of pixels 22. At each pixel location on the LCD Panel 112, the opaqueness of each pixel can be controlled to affect an amount of light emitted from the LED backlight 106 that is transmitted through the LCD panel at each pixel location. The opaqueness of each pixel may be controlled by LCD panel 14 of controller 10. A control signal generated by the controller 10 used to configure the opaqueness of each pixel in the LCD panel can be referred to as a pixel setting. By varying the pixel setting of each of the pixels 22, an image can be formed on the LCD panel 112. The image formed using the pixels 22 and the associated pixel setting for each pixel can be determined from the image data 24, such as a television signal, received by the controller 10.

The amount of light emitted through the LCD panel 112 at each pixel location can depend on how opaque a pixel is and an amount of light emitted from the backlight that reaches the pixel location from each zone of the backlight 106. Thus, the amount of light of light emitted through the LCD panel at a pixel location can be changed by: 1) changing an amount of light reaching a particular pixel location from the backlight; and/or 2) changing the opaqueness of the pixel at the particular pixel location. Methods and apparatus that modify these quantities to improve contrast ration and backlight brightness are described with respect to the following figures.

Figure 1B:
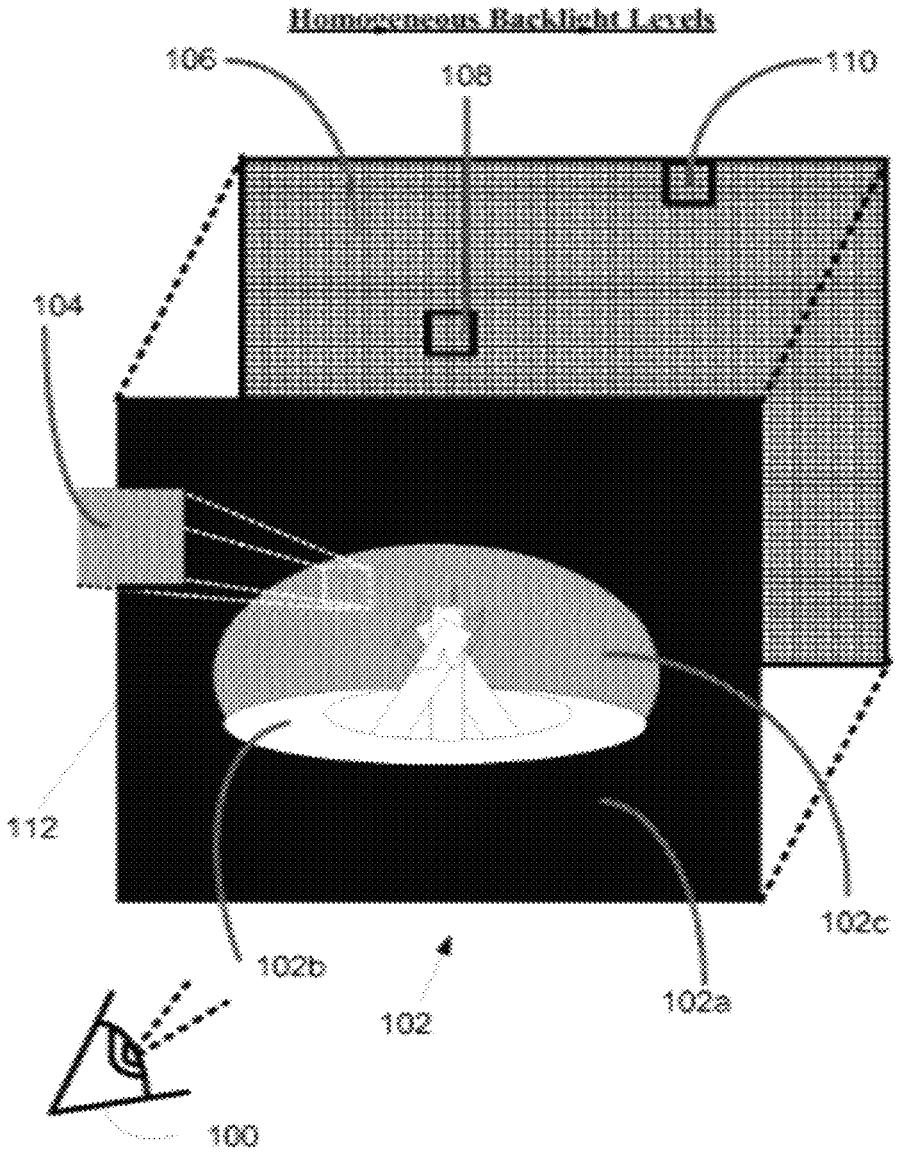
FIGS. 1B and 1C illustrate an LCD panel and a LED backlight where LED backlight lighting levels and pixel data are controlled in accordance with the described embodiments.
Figure 1C:
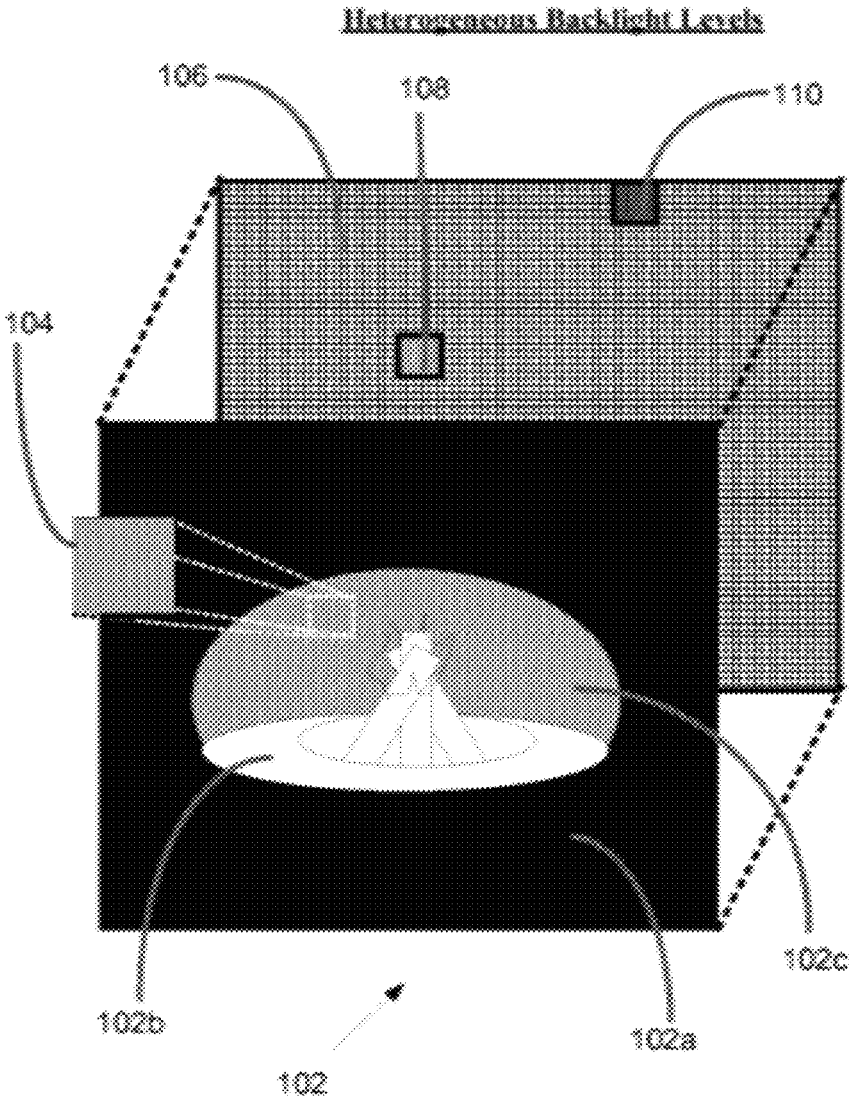

FIGS. 1B and 1C illustrate an LCD panel 112 and a LED backlight 106 where LED backlight lighting levels and pixel data can be controlled in accordance with the described embodiments. The LCD panel 112 can include a number of pixels, such as 104, that can be individually configured using data that corresponds to a particular image. Each pixel can include a number of controllable sub-pixels that allow various colors to be generated. The pixels can be arranged in rectangular array where a product of the number of pixels along each dimension of the rectangular array can correspond to a resolution of the LCD display. The number of pixels in each direction can depend on a display aspect ratio.

In FIG. 1B, an image of a firepit at night is displayed as pixel data 102 on the LCD panel. When a backlight, such as 106, is illuminated, the image generated on the LCD panel can be viewed at a particular viewing angle, such as 100. The pixel data can be generated from the image data. The pixel data can include dark areas, such as 102*a*, bright areas such as 102*b*, and areas in between bright and dark, such as 102*c*.

The backlight 106 can include a number of lighting elements, such as a number of LEDs. As described with respect to FIG. 1A-1C, the lighting elements can be controlled in zones, such as 108 and 110. A zone can include a single lighting element or a group of lighting elements. A controller can be used to control the lighting elements in each zone. For instance, the backlight controller can provide one or more control signals that can be used to set a lighting level for each zone, such as completely turning off a portion or all of the lighting elements in a zone.

At different times or in particular embodiments, the zones and their associated lighting elements can be controlled to emit light in a homogeneous or a heterogeneous manner. When the zones are controlled in a homogeneous manner, the light distribution provided by the backlight can be relatively homogeneous or even across the display panel. In FIG. 1B, the zones, such as 108 and 110, are controlled in a homogeneous manner and all of the zones are configured to emit an equal amount of light. When the zones are controlled in a heterogeneous manner, the light level emitted from each zone can vary from zone to zone and the light distribution provided by the backlight can be brighter in some areas or dimmer in other areas. Thus, the light distribution across the display panel is heterogeneous. In FIG. 1C, zones 108 and 110 are each dimmed relative to their neighboring zones. In particular, zone 110 is dimmed more than zone 108.

The lighting level of each zone, such as 108 and 110, can change over time. In particular embodiments, the lighting level for each zone can be determined from image data, which can change over time. Thus, the brightness of a particular zone can change over time depending on the image data that is to be displayed as will be discussed further below. The number of zones that are controlled and the lighting levels of the zones in FIGS. 1B and 1C are provided for the purposes of illustration only. For instance, other zones can be defined around 108 and 110 that can also be controlled.

As noted above, the lightning level for each zone can depend on image data that is to be displayed to the LCD panel 112. Zone 108 can be associated with image data related to pixel 104. The image data associated with pixel 104 is darker than the areas near the fire but not as dark as image data farther away from the fire. Thus, zone 108 can be dimmed to improve the contrast ratio proximate to pixel 104. Zone 110 can be associated with image data that is mostly dark. Zone 110 can be dimmed more than zone 108 to produce an even greater contrast level and a darker dark.

When the lighting level of a zone is changed, such as a zone is dimmed, a pixel correction factor can be used to modulate the digital pixel data to compensate for the changed amount of light emitted from the backlight. The pixel correction factor can be used to preserve the average brightness of the pixel when it is viewed. For instance, when the amount of light emitted from the backlight is reduced by a certain percentage at a certain location, a brightness of the pixel data associated with this location can be increased by the same amount as the dimming to the preserve the average brightness of the pixel as viewed from a front of the display. When a pixel is brighter in an LCD panel, it can allow more light to be transmitted through the panel.

By way of example, in zone 108, the original backlight intensity value can be $BLI_1$. In one embodiment, $BLI_1$ can initially be a maximum intensity value, such as a value with no dimming, but it can also be an intermediate intensity value as well. The value of an associated pixel, such as 104, can be $PV_1$. The value of the pixel can determine how much light and a color of the light that is to be transmitted through the pixel embedded in the LCD panel 112. After a backlight light intensity value, $BLI_1$, and the pixel value, $PV_1$, are selected, the light intensity of the display that is output via pixel 104 can be measured. An intensity value of the measured light that is output can be referred to as the light intensity at the pixel location, $LI_1$.

The content of a video signal that is to be displayed at a pixel, such as 104, can be used to adjust the LED backlight in a Zone, such as 108 or 110. An objective of performing the adjustment can be to decrease an intensity value of the backlight (i.e., dimming). Dimming can improve black level reproduction and contrast ratio in the pixel areas proximate to the dimmed zones. The backlight can be adjusted in a number of different zones of the LED backlight array. For instance, the backlight can be decreased or dimmed in zones where there are no bright pixels associated with the image data from the video signal.

As an example, the content of the video signal that is backlit by zone 108 (i.e., the content displayed on pixel 104) corresponds to a darker area of the image. The image is darker in this area because it is away from the fire, which is the primary light source in the image. The backlight intensity value in zone 108 can be reduced. The new backlight intensity value in zone 108 can be $BLI_2$. Once the backlight intensity is decreased to $BLI_2$ in zone 108, the light intensity output at pixel location 104 can decrease to $LI_2$ because less light is being emitted from the backlight proximate to the pixel location 104.

In one embodiment, to maintain the original look of the image, the light intensity output before and after the backlight adjustment can be approximately preserved at every pixel location. For instance, as described above, the light intensity output at pixel location 104 may be preserved by maintaining $LI_2$ at pixel 104 equal to $LI_1$ at pixel 104. To maintain the light intensity output at the different backlight intensities, the pixel values, such as the pixel value at 104, may be changed at each pixel location. In particular, the pixel values at each pixel location may be changed by an amount that accommodates the change in backlight intensity levels.

As a simplified example, at a particular pixel location, such as 104, the initial light intensity $LI_1$ output at the particular pixel location can be defined by the pixel value $PV_1$ and backlight intensity value $BL_1$, such that $LI_1=(PV_1)(BL_1)$. The new light intensity output at the pixel location after the backlight intensity value is decreased can be defined as $LI_2=(PV_2)(BL_2)$. To maintain the light intensity output, $LI_2$ can be set equal to $LI_1$, which yields:

$$(PV_2)(BL_2)=(PV_1)(BL_1).$$

Solving for $PV_2$ yields:

$$PV_2=(PV_1)(BL_1)/(BL_2)=PV_1/k.$$

The value $k=(BL_2)/(BL_1)$ is the adjustment made to the pixel value described above. Applying this simplified formula to a single zone and a single pixel associated with the zone, if the backlight in the zone is decreased by 20%, then $BL_2=0.8(BL_1)$ and $1/k=(BL_1)/(BL_2)=1/0.8=1.25$. Thus, $PV_2=1.2(PV_1)$. That is, the pixel value may be increased by 25% to maintain the light intensity output at the pixel.

The example above is referred to as simplified because it involves only decreasing the backlight intensity value in one zone. In other embodiments, the backlight intensity can be adjusted in multiple zones simultaneously. Based on the backlight intensity over all of the backlight zones, a correction factor, k, can be determined for each pixel. After the determination, the pixel value of each pixel can be modified by the correction factor to account for light originating from other zones. Method and apparatus for determining correction factor in this manner are described as follows.

The amount of stray light originating from other zones within backlight can be measured, stored and processed at full panel resolution (on a pixel-by-pixel basis) to determine the correction factor. However, the amount of hardware resources to accomplish this task can be significant in terms of gate count, die size, cost and processing power. In one embodiment, to reduce the size of the required hardware resources to determine the correction factor, a sub-grid with a lower resolution can be used for the calculation instead of working at full panel resolution.

A controller may perform the correction factor calculations on the sub-grid. Details of the controller are described with respect to FIG. 3. In one embodiment, the sub-grid dimensions that are utilized by the controller can be fixed. In another embodiment, the sub-grid dimensions can be a parameter that can be set. In yet another embodiment, calculations can be performed without the use of a sub-grid. The use of a sub-grid can reduce a precision associated with calculating the correction factor. A sub-grid size can be selected based upon an amount of hardware resources and processing power is available and a desired level of precision in the calculation.

Figure 2:
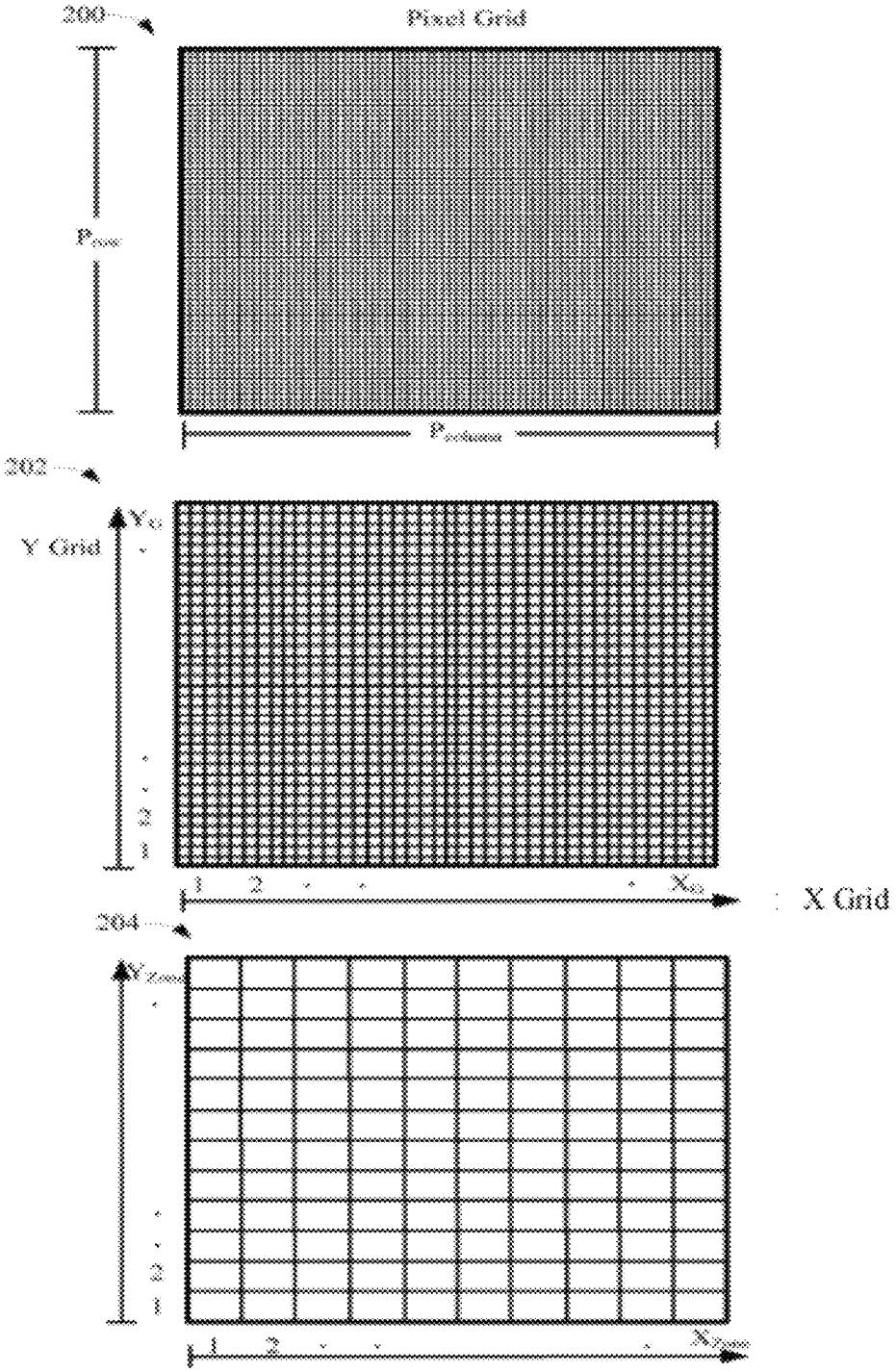
FIG. 2 shows a pixel grid, a correction factor calculation grid and a zone control grid in accordance with described embodiments.

FIG. 2 shows a pixel control grid 200, a correction factor calculation grid 202 and a zone control grid 204. The pixel control grid can represent a number of pixels that are controlled in the LCD panel. The pixels can be arranged in rows and columns with a number of rows, $P_{row}$, and a number of columns, $P_{column}$, where the total number of pixels controlled is the product of $P_{row}$ and $P_{column}$.

The zone control grid 204 can represent a number of zones in the backlight that are controlled. Each zone can represent a region of the backlight unit. In one embodiment, it can be assumed that each zone has a uniform light output. The number and shape of each zone can be determined by the number of light sources in the backlight unit and the way the light sources are grouped, such as the number and grouping of LED light sources. In a particular embodiment, each zone can be driven by with a single control signal. The control signal for each zone can correspond to a desired illumination level for the entire zone. The zones can arranged in rows and columns with a number of rows, $Y_{zone}$, and a number of columns, $X_{zone}$, where the total number of zones controlled is the product of $X_{zone}$ and $Y_{zone}$.

The correction factor calculation grid 202 can represent a number of locations where the correction factor calculation is performed. As described above, a correction factor can be calculated to account for modifications, such as dimming, to various backlight zones. At each location on the correction factor calculation grid, the illumination on the display can be modeled based upon contributions of light from each of the backlight zones. This calculation can be used to determine a correction factor. When the correction factor grid 204 includes less resolution than the pixel control grid 200, the correction factors calculated using the correction factor grid 204 can be interpolated to determine correction factors for each pixel.

In one embodiment, a controller can be programmed to utilize a correction factor grid 202 with up to 384 points in the X direction, $X_{GRID}$, and 256 points in the Y direction, $Y_{GRID}$. As noted above, the number of grid points in the correction factor grid can be less than the number of pixels in each direction. In addition, the controller can be programmed to control a number of backlight zones. In one embodiment, $X_{zone}$ can be up to 24 and $Y_{zone}$ can be up to 16.

Figure 3:
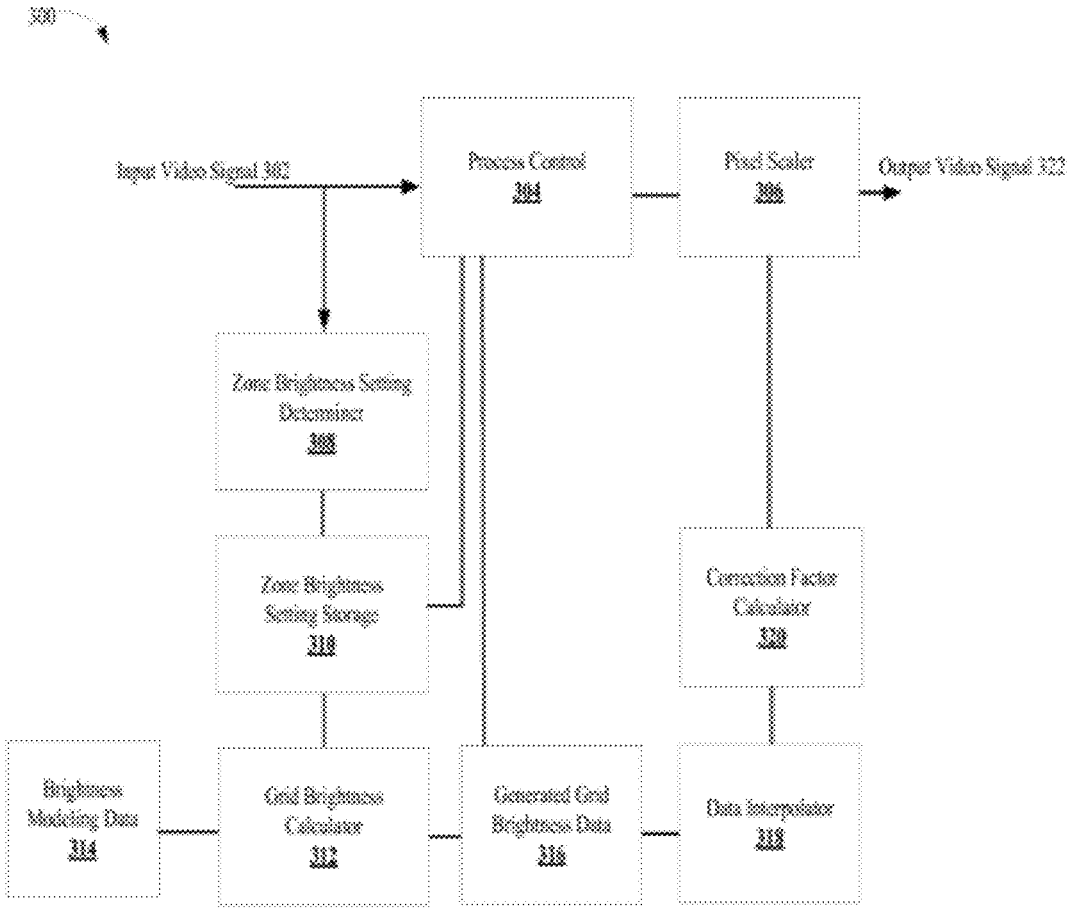
FIG. 3 is a block diagram of a controller in accordance with described embodiments.

In the following figures, a controller for performing the correction factor calculations and more details of the correction factor calculation are described. FIG. 3 is a block diagram of a backlight controller 300 in accordance with described embodiments. The controller is an example of controller 10 described with respect to FIG. 1A. In 302, the controller can receive an input video signal, which may include image data for one or more video frames. In one embodiment, the video signal can be a 14-bit RGB double-wide signal.

In particular embodiments, the process control 304 can be configured to define an active area of an outgoing image. It can be programmed with a grid size of the correction factor grid 202 (see FIG. 2). As described above, in one embodiment, a maximum grid size can 384 columns and 256 rows. The active area can be divided up according the correction factor grid dimensions. It can control the grid brightness calculator 312 and a communication formatter that provides data used to control light sources in the backlight unit (see description of 310 below for more details regarding the communication formatter).

The zone brightness setting determiner 308 can be used to determine a lighting level for each zone of the backlight display based upon received image data. An example of a zone lighting level can be fully ON, partially ON, or OFF. The partially ON setting can comprise a number of intermediate values. The zone brightness setting determiner 308 can determine a lighting level for a particular zone based upon image content that is to be displayed in the zone. In one embodiment, this determination can be done on a frame-by-frame basis.

Figure 4:
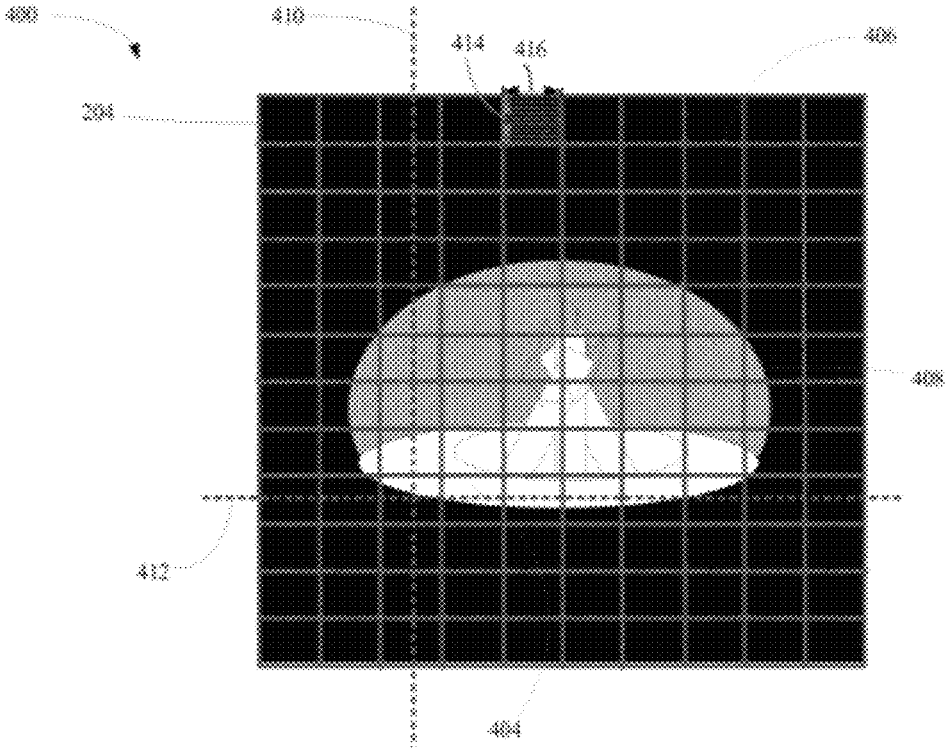
FIG. 4 shows image data overlaid with a zone control grid.

Further details of a procedure for determining the lighting level setting for each zone are described with respect to FIG. 4.

The zone brightness setting determiner 308 can send zone lighting levels for a particular frame to storage 310. In a particular embodiment, zone lighting levels can be stored for up to 10 consecutive frames. The storage can include a circular buffer. After one frame is processed by zone brightness setting determiner 308, a memory in the storage 310 can be populated with zone lighting level values. After the memory is filled, a circular buffer pointer can be used to indicate a next memory in the storage to use. The pointer can point to up to 10 memory locations for storing data associated with 10 consecutive frames. As the memory locations in 310 are filled, the pointer can indicate the memory location of the oldest frame data and this memory location can be overwritten. Embodiments using more or less than 10 consecutive frames are possible and a storage unit, such as 310, can be configured to accommodate the storage of a different number of frames.

The generated zone lighting levels that are determined for each frame in storage 310 can be used a communications formatter (not shown). As previously described, in one embodiment, a backlight panel can comprise up to 24 columns and 16 rows of configurable zones. The communication formatter can translate the zone lighting level settings determined for each zone into a format that is understandable by one or more different LED drivers associated in each zone. The LED drivers can generate one or more control signals that determine a lighting level for each LED in the zone.

In various embodiments, the communication formatter can convert zone lighting level information into PWM information (Pulse Width Modulation). In other embodiment, the communication formatter can provide on and of signals at particular time periods. The communication formatter can be configurable to allow it to work with different LED drivers. For instance, the communication can be a separate programmable microcontroller with its own instruction set.

The grid brightness calculator 312 can be configured to determine a light intensity emitted from the backlight at each grid point in the correction factor grid 202 (see FIG. 2). In particular embodiments, the calculation can determine a light intensity level at a particular grid point in the correction factor grid based upon light contributions from each zone of the backlight unit. The calculation can model how the light emitted from a zone fades with distance. In a particular embodiment, a memory 314 can store the modeling data for the calculation.

In one embodiment, the grid brightness calculations can be formulated such that portions of the calculation are decoupled from other portions of the calculation. This decoupling can allow for calculations to be performed in a parallel. For instance, 2 or more columns or 2 or more rows in the correction factor grid can be calculated in parallel. In one embodiment, calculations are performed for up to 16 columns in parallel. Further details of the calculation are described with respect to FIG. 5.

The brightness model data 314 can store the brightness modeling data for each zone. The brightness modeling data can be used to determine a light intensity emitted from the backlight at a particular location. The data that it stores can be modified to account for different model data and a different zonal configuration. In one embodiment, for each zone, it can contain normalized zone brightness data at all the locations of the correction factor grid including within a particular zone and outside of a particular zone. As described above, it can be used by the grid brightness calculator to model how light diminishes with distance at all positions in the correction factor grid around a lit zone.

The grid brightness calculator 312 can output calculation results that are stored a generated grid brightness data 316. In one embodiment, 3 rows of the correction factor grid can be stored at one time up to the maximum number of columns per row, such as 384 columns per row as described above. One row of stored data can be used as an accumulator that stores brightness values for an on-going calculation. The other two rows can store calculated brightness values. As described above, a number of these calculations can be performed in parallel, such as but not limited to 16 simultaneous calculations.

The generated grid brightness data 316 can be used by the data interpolator to determine brightness values at each pixel location. As is described in FIG. 1, the interpolated brightness values can be used to "scale" each pixel value by a correction factor. For example, the correction factor can be used to increase the light output at a pixel location to compensate for backlight dimming.

In one embodiment, the data interpolator can use a 2-D linear interpolation scheme of the 4 grid points on the correction factor grid surrounding a pixel to determine the brightness value for each pixel. A number of interpolation calculations can be performed in parallel, such as 4 calculations. In other embodiments, higher order interpolation schemes involving more the 4 grid points on the correction factor grid can be used. Further, in some interpolation schemes brightness value calculations performed on one or more previous frames or subsequent frames in a sequence of frames can also be used. For instance, the current brightness value of a pixel can be used in determining the next brightness value. In yet other embodiments, the interpolation calculation can be performed once or multiple times for each frame.

Once the data interpolator has calculated the brightness values for each pixel. The correction factor calculator 320 can determine the correction factors for each pixel. The data interpolator 318 calculates the brightness of the backlight at each pixel location. As previously described, the pixel data can be corrected for varying backlight settings, such as backlight dimming, to maintain an overall front-of-screen brightness level. In one embodiment, to avoid a hardware divider, the brightness values can be inverted using an inverse table. The inverted result can be used as a multiplier to the original pixel data to prevent a divide. The inverted result can provide a correct factor to the original pixel data.

The pixel scaler 306 can use the data from the correction factor calculator 320 to determine new pixel values for each of the pixels in a frame of data. For instance, when an inverse table is used in 320, a scale value and a shift value can be provided. The scaled pixels can be output as output video signal 322. The output video signal can be output on the LCD display screen.

As discussed above with respect to FIG. 3, zone brightness setting determiner 308 can be used to determine a zone brightness setting for each zone. The setting can be determined from image content that is to output to the LCD display. Further details of determining the setting are described with respect to FIG. 4 as follows.

FIG. 4 shows image data 400 overlaid with a zone control grid 204 (see FIG. 2). The brightness of each zone can be determined and the backlight in each zone can be adjusted based upon the image content in each zone. The image content can be formatted as pixel data of a number of rows and columns. Thus, in each zone of the zone control grid there can be a number of rows 414 and columns 416 of pixel data.

To determine an amount of backlight that is to be used, the content in each zone can be analyzed for light and dark objects. When an entire zone is dark or black, the amount of backlight in the zone can be significantly reduced. When there are bright portions in a zone as well as dark portions, then the backlight may not be dimmed as much to maintain the brightness of the bright portions. When an entire zone is mostly bright, then the backlight can be at its maximum value, i.e., the maximum desired brightness setting for the backlight.

As examples, zone 406 is entirely black. In this zone, the backlight can be significantly reduced. In zone 408, which includes darker areas and a slightly lighter area, the backlight can be reduced but possibly not as much as zone 406. In zone 404, which includes a bright area and a dark area, the backlight may have to be almost fully on because the bright area is of a significant size.

A method for assessing a size and distribution of bright objects within in a particular zone can be as follows. In one embodiment, a measure of brightness for a zone can be calculated separately in the horizontal and vertical direction. In a horizontal direction, the pixel data can be IIR (Infinite Impulse Response) filtered on a line-by-line basis, such as along line 412. The lines can cut across multiple zone columns. Along each horizontal line, the peak value from the IIR filter in each zone can be stored. The maximum peak value for each zone can be used as a measure of the size and brightness of the objects within the zone.

In the vertical direction, on a line-by-line basis, such as along line 410, the absolute maximum value determined from the pixel data can be stored for each zone. The maximum values in each zone can be IIR filtered and then stored. A blend of the two values, i.e., one that measures the brightness distribution in the horizontal direction and one that measures the brightness distribution in the vertical direction, can be used as a reference for calculating the required backlight intensity for each zone.

As discussed above with respect to FIG. 3, the grid brightness calculator 312 can be used to determine the brightness at each grid location in a correction factor grid. The brightness calculation can comprise a summation of the lighting contributions from each zone of an LCD backlight at a point in the correction factor grid. The calculation can involve determining, for each grid point, a distance from the grid point in the correction factor grid to a point in each zone, such as to a zone center. Then, a light contribution at the grid point from the point in each zone can be based upon the brightness setting for the zone and a drop off in the brightness based upon the calculated distance from the point in the zone. In one embodiment, the drop off in the light contribution as a function of distance can be stored as tabular data with the brightness modeling data 314 (see FIG. 3).

The brightness calculation can be used to determine a correction factor for adjusting pixel data that is to be output to the display panel. In one embodiment, the zones of the LCD backlight can be driven asynchronously and updated more than once per frame. The timing of how the zones are driven can be considered in the brightness calculation at each grid point in the correction factor grid. Further details of performing a brightness calculation where backlight zones are driven asynchronously can be described with respect to FIG. 5 as follows.

Figure 5:
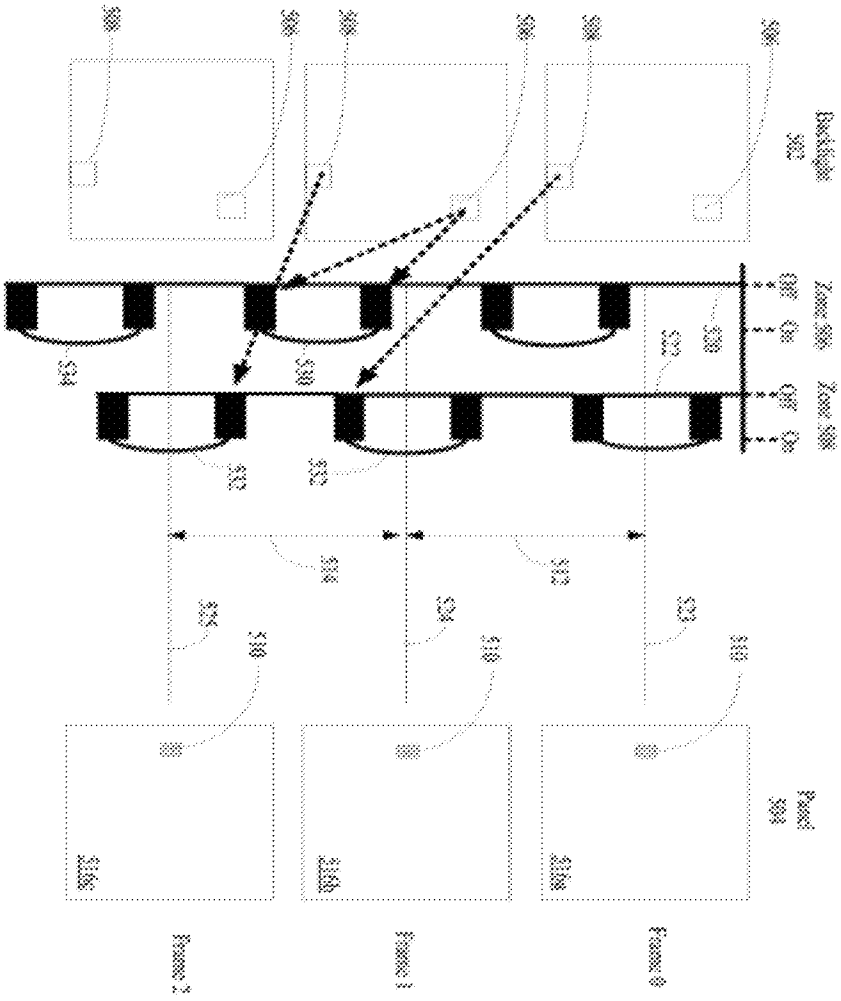
FIG. 5 illustrates timing issues for a light distribution calculation on a correction factor grid for two backlight zones driven asynchronously.

FIG. 5 illustrates timing issues for a brightness calculation on a correction factor grid for two backlight zones driven asynchronously. Two zones 506 and 508 in backlight 502 are shown. A timing signal including on an off pulses for each zone is shown. In one embodiment, the backlight 502 can receive a signal for updating its brightness setting two or more times for each time the pixels on panel 504 are updated with a correction factor. The timing signal 520 is for zone 506 and the timing signal 522 is for zone 508. It can be seen that the on-off signals for timing signal 520 and 522 are offset, such that the zones, are being updated with a signal at different times.

Three frames of data, 516*a*, 516*b* and 516*c* are shown, which are also referenced as frame 0, frame 1 and frame 3, respectively. The pixel 510 can change over time based upon the changing image content associated with each of the frames. For instance, pixel 510 can be updated at times, 523, 524 and 525, respectively. A time period 512 is shown between the grid point update times 523 and 524 and a time period 514 is shown between grid point update times 524 and 525. It can be seen in the figure that the updates times for the zones, i.e., when the zones receive a signal can occur at different times than when the frames, such as 516*a*, 516*b* and 516*c* are updated on panel 504.

Pairs of the signals are shown joined to together. The joined signals can represent a zone brightness setting determined from a single frame of data as is described above with respect to FIGS. 3 and 4. The zone brightness setting can vary from joined signal pair to joined signal pair when the image content changes from frame to frame. For instance, for time signal 520 and 522, each of the 3 pairs of signals can be associated with a zone brightness setting determined from frame 0, frame 1 and frame 2, respectively.

In FIG. 5 over time period 514, the brightness setting of zone 506 can be constant because it is calculated from a signal frame of image data, such as frame 1, represented by the joined signal pair 530 that falls in the time period. However, the contribution from zone 508 may not be constant over the time period 514 because one signal from each two different joined signal pairs, 532 and 534, falls within the time period 514. The two different joined signal pairs, 532 and 534, can be calculated from two different image data frames, such as frame 0 and frame 1. Thus, the brightness setting for zone 508 can change while frame 1 is displayed.

In another example, if the timing of signal 520 were shifted upwards for 506, then both signal pairs 530 and 534 can contribute light during time period 514. The brightness setting for zone 506 associated with signal 530 can be calculated using frame 1 data, while the brightness setting with signal 534 for zone 506 can be calculated using frame 2 data. Thus, in this example, for each time period during when each frame is displayed, brightness settings calculated from 3 more different frames can be output to the backlight 502. In general, while an image is displayed on the display panel 504, a first zone's brightness setting can be determined from a first frame and a second frame directly following the first frame, a second zone's brightness setting can be determined from only the second frame, and a third zone's brightness setting can be determined from the second frame and a third frame directly following the second frame.

Times, such as 523, 524 and 525, when each image is output to the panel 504 can be tracked. For each zone, based upon its timing off-set relative to when the image data is output, the frame or frames used to determine the brightness setting can be determined during each time period, such as 512 and 514, between when the frame data is updated on panel 504. As described with respect to FIG. 3, the zonal brightness settings can be stored in the zone brightness setting storage 310. Thus, for each zone, a single zonal brightness setting calculated from a single frame or multiple zonal brightness settings calculated from two or more different frames can be used in a grid brightness calculation at each grid point.

Figure 6:
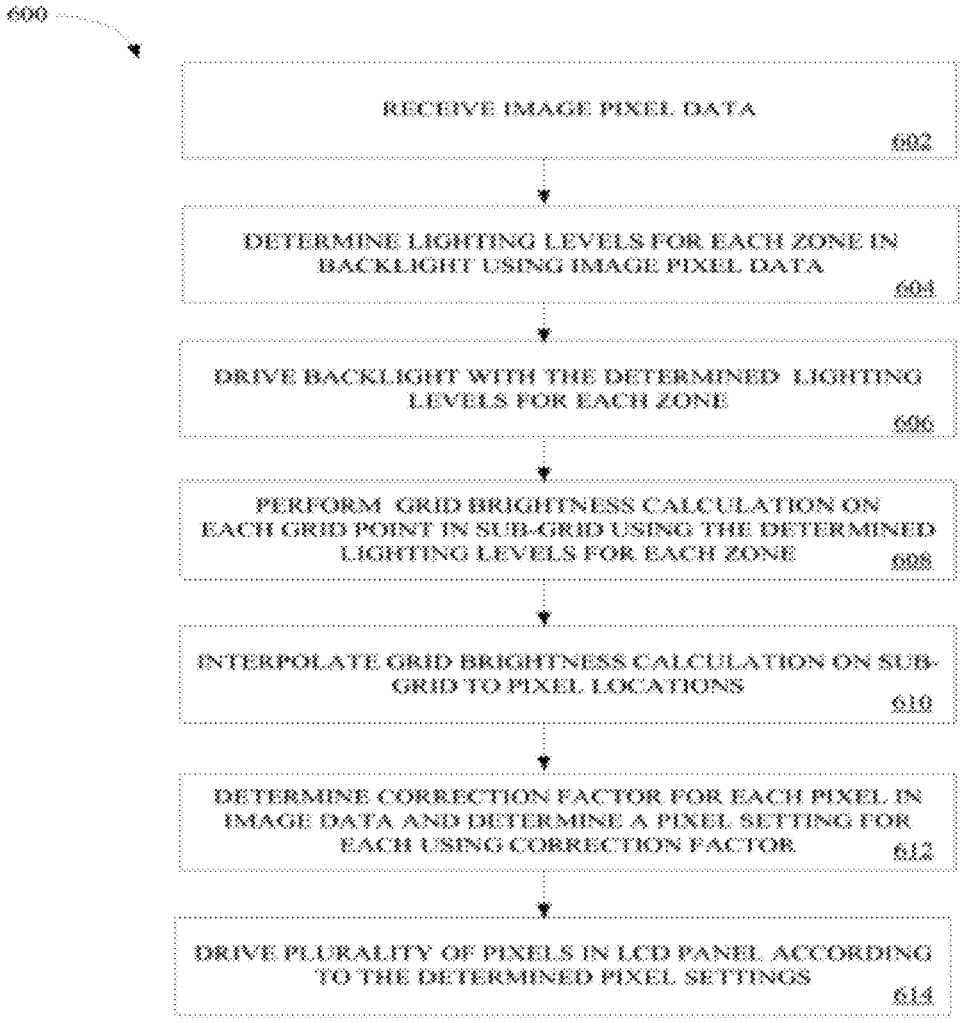
FIG. 6 illustrates a method for controlling a backlight with separately controllable zones and determining a pixel correction factor for image data displayed to an LCD panel.

FIG. 6 is a flow chart of a method 600 for controlling a backlight with separately controllable zones and determining a pixel correction factor for image data displayed to an LCD panel. The backlight for the LCD panel can include a number of light sources, such as a number of LEDs. The LEDs in the backlight can include separately controlled zones where each zone includes one or more of the LEDs. In 602, image data can be received. For example, a controller associated with a display can receive a video signal containing image data, such as a sequence of pixilated frames.

In 604, based upon content contained in the image data, such as the content of a single frame, a zone brightness setting associated with the frame can be determine for each zone in the backlight. The zones of the backlight can be mapped to a frame of the image data. For instance, a frame of the image data can be mapped to a zone control grid. The content of the image data in each zone of the zone control grid can include bright and dark areas. A brightness setting for the zone can be determined based upon a distribution of bright and dark areas in the zone. In particular embodiments, when the image content in a zone is dark or mostly dark, the brightness of a particular zone can be decreased. For example, the brightness of the zone can be decreased by dimming the LEDs in the zone to reduce the amount of light emitted from the zone or by selectively turning off one or more of the LEDs in a zone. Dimming the light output in a zone can increase a contrast ratio of an image displayed on the LCD panel and can provide darker dark colors, such as darker blacks.

In 606, each of the zones in the backlight can be driven according to the determined zonal backlight settings. In particular embodiment, the zones can be driven asynchronously to one another. The zones can also be driven asynchronously relative to when the frames used to generate the zonal backlight settings are displayed.

In 608, a grid brightness calculation can be performed at each grid point on a sub-grid. The resolution of the sub-grid can be coarser than the resolution of the pixilated frame data. In one embodiment, the resolution of the sub-grid, such as a maximum x dimension and a maximum y dimension can be set.

The grid brightness calculation can involve determining a light contribution from each zone in the backlight to the light at each grid point over a time period. The time period can be the time that a frame in the image data is displayed. When zones are driven asynchronously, a zone brightness setting in a zone can change while a frame is being displayed. The grid brightness calculation can be modified to account for a change in the light contribution from a particular zone when its brightness changes over a time period for which the grid brightness calculation is used, such as the time period during which a frame is displayed, In 610, the grid brightness calculation performed on each grid point can provide a value. In one embodiment, a number of the grid calculation can be performed in parallel. The values determined on the sub-grid can interpolated to pixel locations in a frame of pixel data. In one embodiment, linear interpolation using grid point surrounding each pixel locations can be used.

In 612, a correction factor for each pixel in the image data can be determined. The correction factor can be based upon the value of the grid brightness calculation interpolated to each pixel. In one embodiment, correction factor can be calculated from the value of the grid brightness calculation at each pixel location using an inverse table to avoid a divide. The correction factor can used to determine a pixel setting of each pixel so that an average image brightness is maintained when one or more zones of the backlight are dimmed. In 614, the determined pixel settings can be output to an LCD display panel.

The methods described above and in patent application Ser. No. 12/727,020 (incorporated by reference above) use a large amount of memory and model the light field on a per-zone basis. The following descriptions disclose additional apparatuses and methods for significantly reducing memory requirements and for modeling the light field on a per-source basis. Modeling the light field on a per-source basis allows for calibration of the intensity of individual LEDs within a zone, thereby reducing the LED binning requirements, which is expected to reduce LED cost by at least 10%. Individual LED calibration also provides a more uniform display brightness.

The methods and apparatuses described above and in U.S. patent application Ser. Nos. 12/727,020 and 12/780,721 store a three-dimensional (3D) contour shape of the light intensity at grid points around a zone in a two-dimensional (2D) contour table in memory, taking one (1) memory location for each grid point (typically, 128×128). An example of the 3D contour shape is shown in FIG. 5 of U.S. patent application Ser. No. 12/780,721. The additional methods and apparatuses disclosed below store data points only at vertex points on the 3-D contour shape. A vertex point is defined as a grid point at which the slope of a horizontal line must change in order to stay close enough to the original curved 3D contour, Generally, the light fields created by LCD backlights are fairly smooth and become smoother further from the source. The smoother the light field is, the less vertices are required to model the light field. In some embodiments, this method may reduce the memory requirement by a factor of about 16. Also, this method performs calculations only upon vertices, instead of all grid points, reducing the required number of parallel calculations from 16 to 4 while simultaneously increasing the number of light sources from 512 (zones in earlier method) to 2048 (sources in the new method).

Grid Brightness Calculations—

In an exemplary embodiment of the disclosure, grid brightness calculations are performed for individual light sources (e.g., LEDs), instead of individual zones. Typically, a zone comprises a number of light sources. To reduce the number of calculations required and the size of the source contour tables, an encoding scheme may be used. A delta (Δ) encoding scheme may be adopted that has specific qualities suitable for this operation, namely: 1) a significant reduction in contour table data points; 2) the fact that significant portions of the source contour shape are smooth allows for reduction of data points in those areas; 3) the data points may be scaled and the contour shape is maintained; 4) expansion of the data points up to the resolution of the grid is performed during grid brightness interpolation, not at the time of grid brightness calculation, requiring only one grid brightness calculation per data point; and 5) the raw contour data derived from camera measurements may be smoothed by means of off-line data calculations (allowing for data point reduction) without reducing the accuracy of source contour shape representations.

FIG. 7 illustrates a selected portion of 3-D contour shape 710 in accordance with described embodiments. Because the contour tables contain a data point at each grid point, and because those data points are later interpolated to create the pixels, the resulting contour shape 710 is made of many flat facets (e.g., facets 711-715), with one facet per grid point. Thus, each grid point may be considered to be a vertex on the surface of the 3-D shape of contour 710.

Figure 7A:
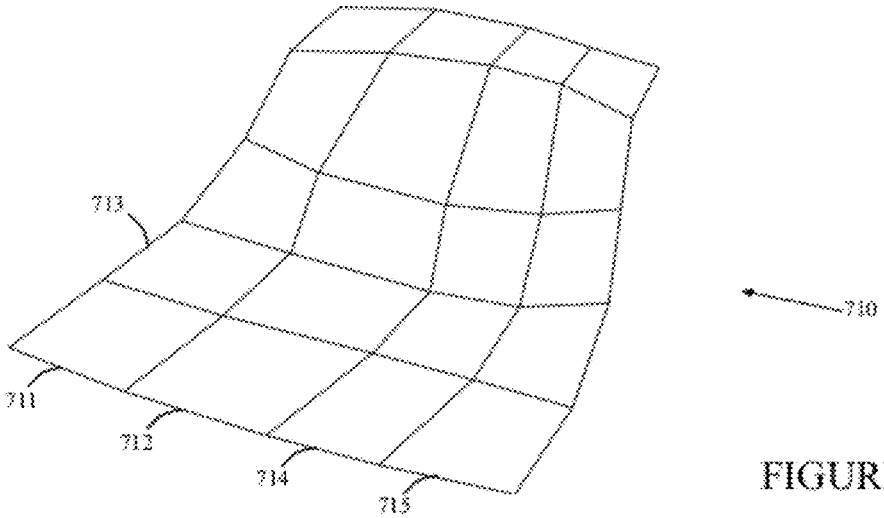
FIGS. 7A and 7B illustrate partial light source contour shapes in accordance with described embodiments.
Figure 7B:
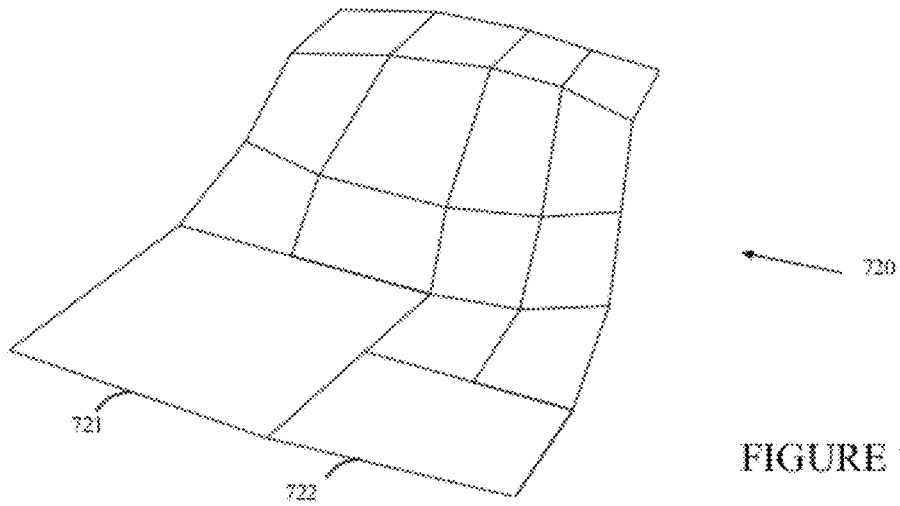

FIG. 7B illustrates a selected portion of 3-D contour shape 720 in accordance with described embodiments. Because much of the contour shape is smooth, the number of vertices required to accurately describe contour shape 720 may be significantly reduced, because larger flat facets may be combined and used in smoother areas without incurring undue errors. By way of example, facets 711, 712 and 713 in FIG. 7A are combined into facet 721 in FIG. 7B. Similarly, facets 714 and 715 in FIG. 7A are combined into facet 722 in FIG. 7B.

Advantageously, the contour table contains data points only for these required vertices, reducing the number of data points by a factor of 10 to 20. Because the data points each represent a vertex, the data value represents a change in horizontal slope at that point instead of an actual brightness value. The change in slope can be scaled in the same way that that actual brightness values are scaled. Once the slope is changed at a vertex, the new slope value is maintained until the next vertex point, which may be many grid points ahead. Consequentially, no grid brightness calculations are required for the grid points that have no vertex.

The contour shape is three dimensional, so a change of horizontal slope (i.e., a vertex) changes all slopes to the right of its grid position. But the change is also propagated downward and changes horizontal slopes at all grid points below a position. Thus, each vertex changes the horizontal slope of all grid points below and to the right of the vertex.

The advantages of this scheme for calculating grid brightnesses are as follows: 1) calculations are performed separately for each source, rather than for a whole zone (which is typically a collection of sources), allowing us to calibrate the light intensity (and color) of each source independently of the others. Independent calibration of sources relaxes the requirements for matching LEDs (i.e., binning), significantly reducing the cost of the LEDs, while maintaining or improving backlight uniformity; 2) different source contour shapes can be used for each LED color, allowing for improved color uniformity in an RGB backlight system, since it is almost impossible for three LEDs (red, green, and blue) to create the same light pattern because they must be in different locations; 3) larger, more complex, and varied contour patterns are possible without any significant increase in memory requirements within the module; and 4) the number of parallel calculation is reduced from 16 per color to 4 per color, reducing the die size of the module.

Grid Brightness Calculations Architecture 800—

Figure 8:
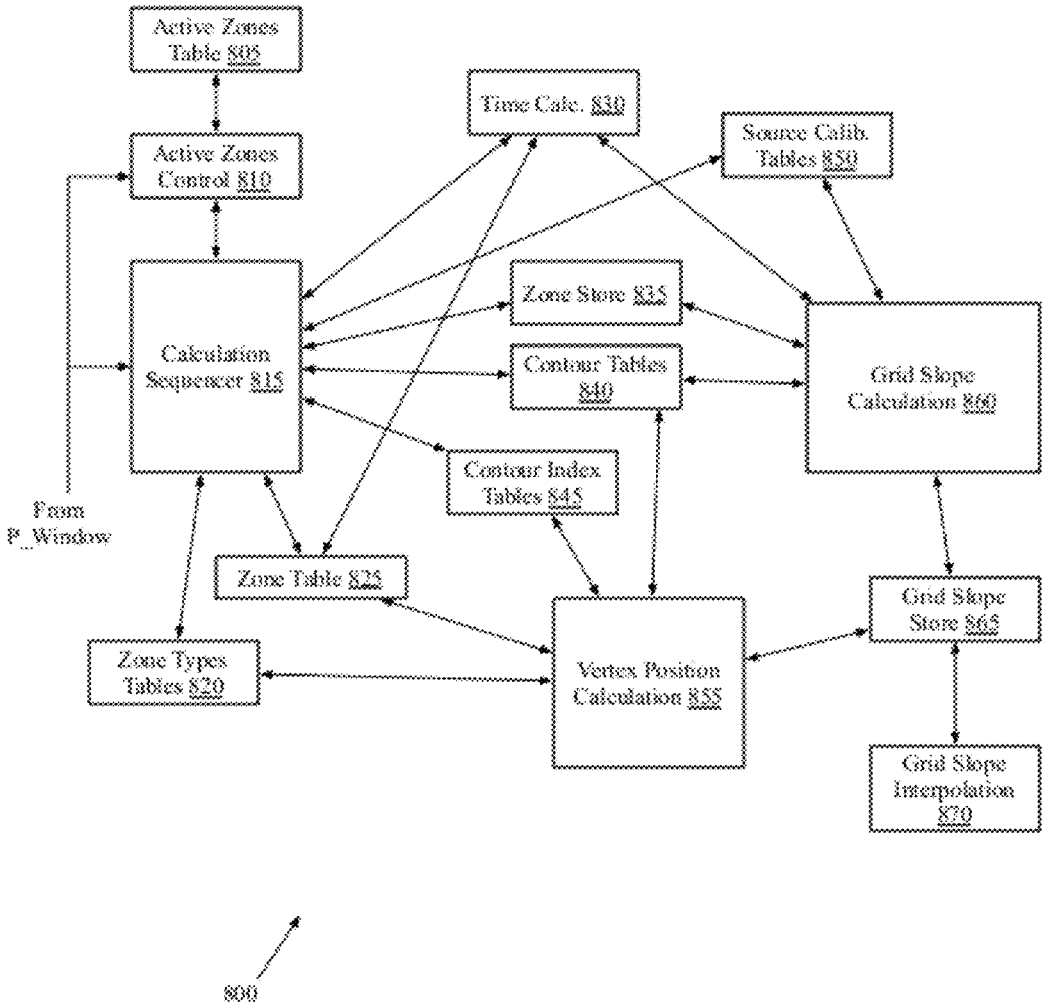
FIG. 8 illustrates a grid brightness calculation architecture according to one embodiment of the disclosure.
Figure 9:
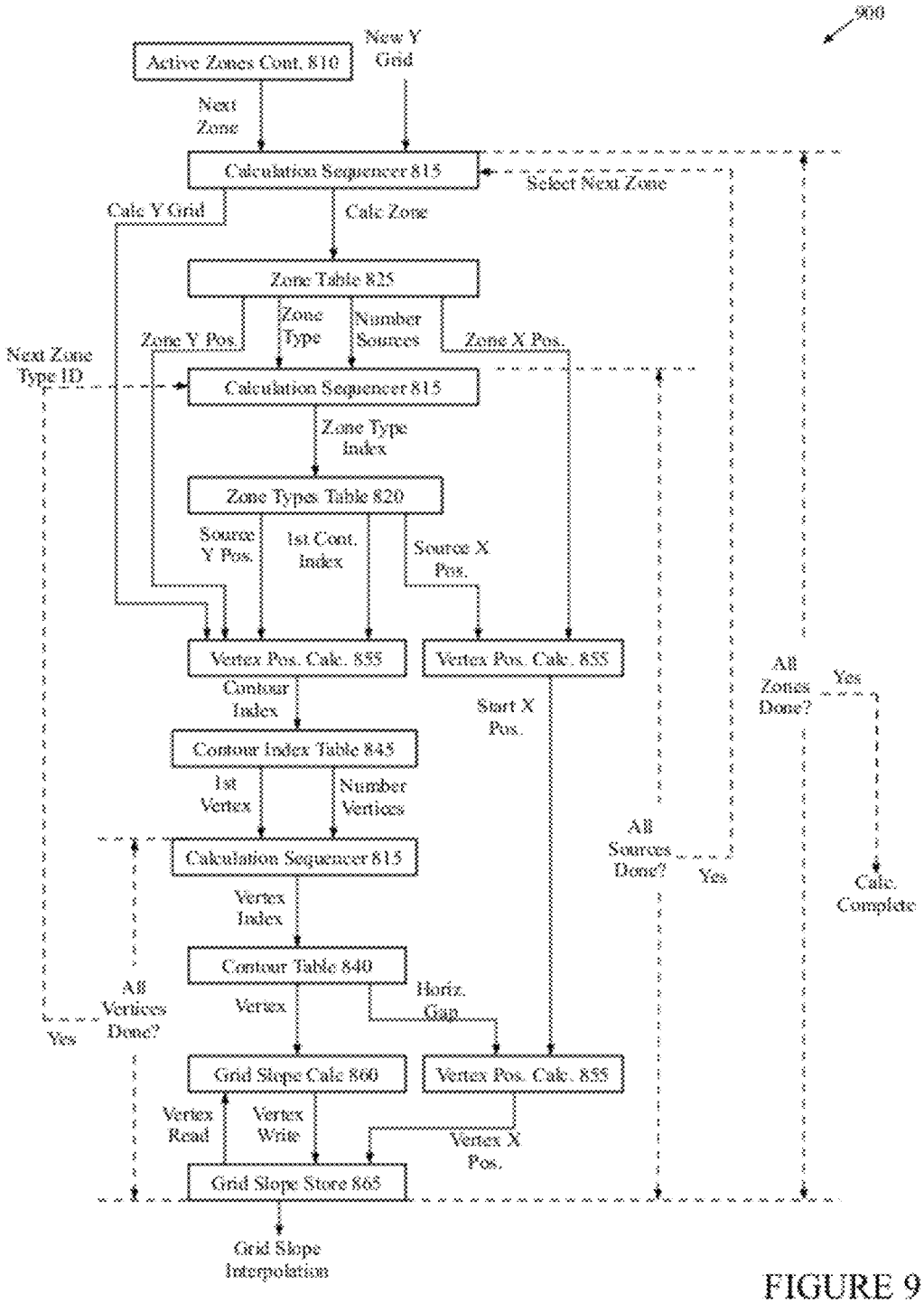
FIG. 9 illustrates a method of operating a calculation sequencer for modeling the light field in accordance with the described embodiments.

In exemplary embodiments, the methods and apparatuses for generating grid brightness calculations using stored data points associated with vertices on a 3-D contour shape may be performed by grid brightness calculations architecture 800 illustrated in FIG. 8 and the method illustrated in FIG. 9. In an advantageous embodiment, grid brightness calculations architecture 800 and the method in FIG. 9 may be implemented using one or more controllers and/or video processors that contain internal memories or are coupled to external memories that are configured to store the data tables described below.

FIG. 8 illustrates grid brightness calculation architecture 800 according to one embodiment of the disclosure. A noted above, grid brightness calculations may be performed on the horizontal slope of the grid brightness, instead of actual brightness values. Each data point in the contour table (a vertex) represents a change of horizontal slope at that point. This allows the skipping of data points at grid locations where the slope does not significantly change. Calculations are run on one Y grid at a time, with the completed results from the two (2) earlier Y grids being interpolated to create pixel brightness for the current active pixel. The calculations for a Y grid are performed one zone at a time, sub-divided into calculations of one source at a time. In an exemplary embodiment, up to 8 vertices are calculated in parallel.

Because many grid locations within a source contour do not require a vertex, there are a variable number of vertices per Y grid within each source contour. Also, because source contours are placed at different locations in the frame, there are many frame Y grids for which a particular source contour has no vertex.

In order to minimize wasted calculation clock cycles that would select zone/source combinations that would yield no Vertices, there is an Active Zones Table 805, which indicates, for any particular frame Y grid, which zones are likely to have vertices, thus skipping zones that have none. There may be a variable number of sources for each zone, and a variable number of vertices in each Y grid of a source. To handle this complexity, Calculation Sequencer 815 is provided.

Each vertex is a change of horizontal slope for all grids to the right and below the vertex position. Thus, vertices that are above or to the left of the active area of the frame must still be calculated because they affect all later grids. During the calculation of a frame Y Grid, any vertices that fall to the left of the active area are calculated and summed into OffLeft slope and OffLeft value registers. Grid Slopes Interpolator 870 uses these registers as the initial slope and value. Calculation of vertices that fall above the active area is more difficult because there are potentially a lot of them and these vertices must all be calculated at once, not a few at a time like the vertices that fell off the left side. A special Grid Slope Store 865 is provided for frame Y Grid 0. After calculating all vertices for each Y Grid, spare cycles are used to calculate vertices that fell off the top for the next frame, placing the results in the special Y Grid 0 Slope Store.

Zones may be flipped horizontally and/or vertically. Sources within a zone may also be flipped horizontally and/or vertically. Also, the source contours may be horizontally, and/or, vertically symmetrical. In order to be horizontally symmetrical, the horizontal slope of a source contour along the vertical line of symmetry must be zero.

As noted above, up to 8 vertices may be calculated in parallel. These 8 vertices are actually 2 blocks of 4 vertices. All 4 vertices in a block must belong to the same source, but the 2 blocks calculate vertices from different sources. If at any time there are less than 4 vertices available for a source, the remaining vertex calculations in a block are not used. Vertices are stored in the Contour Table 840 in blocks of 4. In order to calculate 2 blocks of 4 vertices in parallel, the Zone Types Tables 820, Contour Index Tables 845, Contour Tables 840, and Source Calibration Tables 850 support dual port reads. In an exemplary embodiment, calculations are performed independently for each color. Source Calibration Table is a 3-color table, which applies individual calibration to each color of 8 vertices. Different source contour shapes may be used for each of the colors. In the independent color mode, the sources that make up a zone are each allocated to only one color, in the sequence red, green, blue.

In an exemplary embodiment, Grid Slope Store 865 holds summed vertices for the Y Grid being calculated and horizontal slopes for the 2 previous Y Grids (above grids and below grids). The summed vertices represent changes of horizontal slopes. During vertex calculations, the vertices are summed into the calculating Y Grid of the Grid Slope Store 865. Once those calculations are completed, the summed vertices in the calculating Y Grid are processed left to right and converted into horizontal slopes by sequential summing. When the current active frame Y Grid is completed, the Below Grid data is copied to the Above Grid Store and the Calculating Grid data is copied to the Below Grid Store. In an exemplary embodiment, a parallel shift register structure is used.

Calculation Sequencer 815—

Calculations of the light field using vertices may be quite irregular, because not all grid points have a vertex. Consequently, Calculation Sequencer 815 may be used to control the flow of data collection and calculation. There are 3 types of Grid Slope calculations: 1) the Current Y Grid calculations, 2) the Y Grid 0 calculations, and 3) the Grid Slope calculations, all of which are controlled by Calculation Sequencer 815. Calculation Sequencer 815 starts the Current Y Grid calculations following the NewYGrid signal (from P_WINDOW). When the Current Y Grid calculations are complete, the Y Grid 0 calculations, and the Grid Slope Calculations are started. The Y Grid 0 calculations are the same as the Current Y Grid calculations, except that the calculations are performed on vertices that fall on or above Y Grid 0. There is a separate grid slope store 805 for each type. If the Y Grid 0 calculations are not completed before the next NewYGrid signal, the calculations are paused, and continued after the new Current Y Grid calculations for the new Y grid are complete. The Grid Slope calculations must be completed before the next NewYGrid signal.

Vertex Calculations—

FIG. 9 illustrates a flow diagram 900 for operating Calculation Sequencer 815 for modeling the light field in accordance with exemplary embodiments of the present disclosure. Both the Current Y Grid calculations, and the Y Grid 0 Calculations are sequenced as shown in FIG. 9. The Active Zones Controller 810 either supplies the number of the next active zone, flags that all zones are done, or flags that it is searching for the next active zone. Following the NewYGrid signal. Calculation Sequencer 815 sets the Calc Zone to the Next Active Zone from the Active Zones controller 805. The value Cale Zone is used to read an entry from Zone Table 825, which provides the position of the zone (including orientation), the zone type (First Zone Type Index), and the number of sources in the zone.

Sequencer 815 selects each of the sources in a zone, in turn, by incrementing the Zone Type Index, when processing of each source is complete. When all the sources within a zone are processed, Sequencer 815 selects the next Active Zone from the Active Zone Controller 810, and continues as before until all zones have been processed, at which time Sequencer 815 halts. There is one entry in the Zone Types Tables 820 for each source in a zone, accessed by the Zone Type Index value. The Zone Type Index is used to read an entry from Zone Types Tables 820, which provides the position of the source (including orientation), and an index to the first entry in the Contour Index Tables 845 for that source. There is one entry in the Contour Index Tables 8445 for each Y grid position in a Source, accessed by the Contour Index.

Sequencer 815 uses Cale Y Grid, together with the positions, and orientations of both the zone and the source to calculate the Current Y Position within the source. This position is then added to the First Contour Index to create the Contour Index. The Contour Index value is used to read an entry from Contour Index Tables 845, which provides the number of vertices, and an index to the first vertex in Contour Tables 840 for the Y Grid within the source. Each entry in Contour Tables 840 contains up to 4 vertices. The Contour Index is capable of selecting any one of the 4 vertices in the entry. Only the selected vertex and later vertices within the entry are read.

Sequencer 815 selects each of the blocks of vertices, in turn, by adding 4 to the Contour Index, after rounding down to a multiple of 4, when processing of each block is complete. When all the vertices in a Y Grid of the source have been processed, the processing of that source is complete, and Sequencer 815 selects the next source from the Zone Types Tables 820 as described above.

Dual Calculations Blocks—

As mentioned above, vertex calculations occur in 2 blocks of 4 vertices, and each block uses vertices from a different source. The two sources may be from the same zone or from different zones. To support this operation, the Zone Types Tables 820, Contour Index Tables 845, Contour Tables 840, and Source Calibration Tables 850 have dual ports, thereby allowing two (2) simultaneous read operations. Also, Grid Slope Calculations module 860 and Vertex Position Calculations module 855 both perform eight (8) calculations in parallel. Calculation Sequencer 815 controls the 2 data paths, sequencing each path somewhat independently. Each time that one of the paths completes all of the vertex calculations for a source, Sequencer 815 starts calculating the next source, which may or may not be from the same Zone, as the other path.

There are usually more than one Zone Types entries for each Zone Table entry because there is usually more than one source per zone. Consequently, there is no need for Zone Table 825 or Zone Store 835 to perform dual reads. Calculation Sequencer 815 keeps Zone Table 825 and Zone Store 835 reads one entry ahead of the zones being processed, so that as soon as calculations for the current zone(s) are completed, calculations can start on a new zone. After Sequencer 815 selects a new zone in Zone Table 825 and Zone Store 835, new Zone Position, Orientation, and Brightness values are generated. Also, the Time Calculation module 830 produces a new Zone Time value. These values are fed to Vertex Position Calculation module 855 and Grid Slope Calculation module 860, which have 2 sets of latches to hold these values for either of the calculation paths. Sequencer 815 issues control signals that cause the values to be stored in the correct latches.

The Grid Slope calculations sequence begins after the Current Y Grid calculations are complete, and simply count through each X Grid from left to right.

Active Zones Table 805—

Each entry contains the four data fields shown in the figure. Each entry in the Active Zones Table 805 (FIG. 10) indicates one or more zones that become active or inactive when the Y Grid being calculated (CalcYGrid) equals the ActYGrid value in the entry. There are a total of 256 such entries in Active Zones Table 805. There may be more than one entry per Y Grid. The table size is 256 entries of 22 bits=5632 bits=704 bytes. The entries must be sorted in order of ascending Y Grid. Entries are selected by ActZSel from Active Zones Control 810. Unused entries must be below all used entries and contain a NumberXZones value of 0. The status of a selected zone is toggled between active and inactive. Entries for Y grid 0 must contain all the zones that have vertices that fall at or above Y Grid 0. The NewYGrid signal (from P_WINDOW) causes the current CalcYGrid to increment. Active Zones table 805 entries that have an ActiveYGrid value that matches the current CalcYGrid value are processed, thereby enabling or disabling zones.

Active Zones Control Module 810—

Active Zones Control module 810 contains the Zones Status Store, which has a 1-bit register for each zone, indicating active or inactive status. Active Zones Control module 810 accesses Active Zones Table 805 using ActZSel. Following a NewYGrid, if the ActYGrid read from Active Zones Table 805 equals the new CalcYGrid (derived from P_WINDOW), then the current entry in Active Zones Table 805 is processed. The values FstXZone and FstYZone from each entry in Active Zone Table 805 are used to select the appropriate bit in the Zones Status Store, which is then toggled. Similarly, following bits in the Zones Status Store may be toggled, with NumXZones (from the Active Zone Table entry) controlling how many bits are toggled.

After an entry has been processed ActZSel is incremented to access the next entry. If the ActYGrid of the new entry is also equal to CurrYGrid, then that entry is also processed. Entries in Active Zones Table 805 are selected and processed until an entry is reach in which ActYGrid does not equal CalcYGrid. Grid slopes are only calculated for vertices in the sources of active zones. All register bits are reset to 0 by a new frame.

Zone Table 825—

Zone Table 825 (FIG. 11) has 512 entries (one per zone) selected by CalcXZone and CalcYZone from Calculation Sequencer 815. Only active zones are selected. Each entry selects a Zone Type, and orientation, the number of the first source for that zone, and the number of sources in the zone. Each entry in Zone Table 825 contains the six data fields shown in the figure. The table size is 512 entries of 44 bits=22,528 bits=2,816 bytes. ZoneXPos and ZoneYPos should indicate the position of the center of the zone because, if the zone is flipped, the center is used as the pivot point. Zone Table 825 is used the same for all 3 colors, so although separate sources may be used for each of the colors, the position and orientation of the zone must be the same for all 3 colors. Because Zone Table 825 is 44 bits wide, the data may be split into a 32-bit word, followed by a 12-bit word.

Zone Types Tables 820—

Zone Types Tables 820 (FIG. 12) has 256 entries. Each entry in Zone Types Table 825 contains the four data fields shown in the figure. The table size is 256 entries of 33 bits=8,448 bits=1,056 bytes. Because Zone Types Tables 820 is 33 bits wide, the data is split into a 22 bit word, followed by an 11 bit word. FstContrldx appears in the second word bits (11:0]. Each entry contains information about one of the sources that make up a zone. Zone Type Index (from Calculation Sequencer 815, derived from Zone Table 825) selects the first source that makes up a zone (First Contour Index). There may be more than one entry for a zone. Zone Types Tables 820 supports simultaneous dual port reads driven by two Zone Type Indexes provided by Calculation Sequencer 815. Each read port provides a First Contour Index, source Position, and source Orientation to the Vertex Position Calculation module.

The number of the first source within a zone is given by first source from Zone Table 825, with subsequent sources numbered incrementally. If the register bit SEP_COL_SRCS=1, each of the 3 colors (red, green, and blue) may use separate sources. In this mode, the first source selected by Zone Type Index is for red, the second for green, and the third for blue. This sequence repeats up to the last source.

Contour Index Tables 845—

Contour Index Tables 845 (FIG. 13) has 2048 entries. The table size is 2048 entries of 20 bits=40,960 bits=5,120 bytes. Each entry in Contour Index Tables 845 contains the two data fields shown in the figure. Each entry selects the First Vertex in Contour Tables 840 to be used for a Y Grid within a source contour and the Number Vertices in that Y Grid. Any of the 4 vertices in each entry in Contour Tables 840 may be selected as the first. Contour Index Tables 845 supports simultaneous dual port reads driven by two Contour Index pointers.

The Contour Index Table entry is selected by Contour Index which is calculated by the Vertex Position Calculator module 855 based the following values: 1) The current CalcYGrid; 2) ZoneYPos, and ZoneOrient from the Zone table; and 3) SourceYPos, FstContourIndex, and SourceOrient from the Zone types table. There must be an entry for every Y Grid of every source when the zone that contains the source is active. An empty entry may be created by setting Number Vertices to 0.

Contour Tables 840—

Contour Tables 840 (FIG. 14) contains 2,048 entries. The table size is 2,048 entries of 128 bits=262,144 bits=32,768 bytes. Each entry in Contour Table 840 contains the eight data fields shown in the figure. Each entry contains up to 4 vertices and the horizontal gaps between them. Contour Tables 840 supports simultaneous dual port reads driven by two Select Vertex pointers from the Calculation Sequencer, derived from two First Vertex values from Contour Index Tables 845. Each read port provides 4 vertices for Vertex Calculations. Following Vertices in Contour Table 805 may also be used for the same Y Grid, with the total number of vertices being set by Number Vertices from Contour Index Tables 845, all under the control of Calculation Sequencer 815. The Horizontal Gap between the previous vertex and the current one is selected by HozGap from a list of possible Gaps, as show in TABLE 6 (FIG. 15).

Source Calibration Tables 850—

Source Calibration Tables 850 contains a 12-bit entry for each of red, green, and blue, for each of the possible 4,096 sources (i.e., LEDs). The table size is 4,096 entries of 36 bits=147,456 bits=18,432 bytes. The vertices in each source are multiplied by the appropriate values in Source Calibration Tables 850, then shifted right 12 times. The source number from Calculation Sequencer 815 addresses Source Calibration Tables 850. The data may be concatenated as: {B[11:0], G[11:0], R[11:0]}. Because the source calibration is applied to the source vertices after multiplication by the zone brightness, it only effects the compensation of panel pixel data. Because source brightness has an inverse effect on the final pixel brightness, increasing a source calibration value will decrease the final pixel brightness.

Vertex Position Calculation module 855—

The unit of measure for the positions of the vertices is X and Y Grids. Source contour shapes will overlap the left and top of the active area of the frame. The top left grid of the active area of the frame is Grid 0,0, so the final calculated positions of vertices that fall over the left or top of the active area will be negative. The vertices being calculated are always to be positioned on the current CalcYGrid. However they may be placed at any X Grid. There are 2 blocks of 4 Vertex Position Calculations, in parallel. The normal X Grid position of a source is determined by a combination of the following: 1) the horizontal position (ZoneXPos) and orientation (ZoneOrnt) of the current CalcZone from Zone Table 825; 2) the horizontal position (SrcXPos), and orientation (SrcOrnt) of the source within the zone from the selected entry of Zone Types Table 820; and 3) the sum of the gaps selected by the HozGap values (from Contour Tables 840) of all vertices from the First Vertex (from Contour Index Tables 845) up to, and including, the current vertex. For normal orientation the X Grid position of a vertex is the sum of ZoneXPos, SrcXPos, and the sum of the gaps. However, the Zone may be flipped horizontally, the source may be flipped horizontally, or the source may be horizontally symmetrical.

Grid Vertex and Slope Calculations—

The calculation of slopes is split into 3 types.

In a first type of calculation, the current Y Grid Vertex calculations are performed separately on up to 4 vertices per color. Each color may have its own vertices. Otherwise, the same vertices are used for all colors. Each vertex is multiplied by the Zone Brightness for the appropriate color, the zone on time, and the source calibration for the appropriate color. At the same time, the horizontal X Grid position of each vertex is calculated. Each modified vertex with a horizontal X Grid position greater than 0 is then added into the correct X Grid location in the CalcYGridSlopeStore. Vertices with a horizontal X Ggrid position of 0 or less are treated differently. All such vertices are added into the grid 0 entry of the CalcYGridSlopeStore, representing the initial Horizontal Slope. The Grid 0 entry is larger than the other entries to avoid overflow during calculations. The vertex is also multiplied by (1—X position) and added into the CalcYGridInitVal register, giving the Initial Output Value. The Current Y Grid calculations begin following a NewYGrid and continue until all the vertices of all the sources in all the Active Zones have been calculated. After the Current Y Grid calculation ends. the other 2 types of calculations begin in parallel.

The second type of calculations is the Y Grid 0 Vertex calculations, which are the same as the Current Y Grid calculations, except that only vertices that fall at or above Y Grid 0 are calculated for the next frame. The results of these calculations are summed into the YGrid0SlopeStore. If these calculations are not completed before the next NewYGrid they are paused and continued in spare time in the next Y Grid. At the end of the current frame, the accumulated results in the YGrid0SlopeStore are copied to the CalcYGridSlopeStore.

The third type of calculations is the Grid Slope calculations, which occur at the same time as the Y Grid 0 Vertex calculations. Each X Grid location in the CalcYGridSlopeStore is taken in turn, starting at X Grid 0. Each location is replaced with the sum of this, and all previous locations. This calculation replaces the summed vertices (which are changes in horizontal slope) with actual Horizontal Slope values. The Horizontal Slope values are rounded from the precision of the CalcYGridSlopeStore to the precision of the AboveYGridSlopeStore, with the rounding errors carried to the right and included in the calculation of the next X Grid. These calculations must be complete before the next NewYGrid.

Grid Slope Store 865—

The Grid Slope Store 865 has 384 X Grid entries for each of 4 Y Grids. The CalcYGridSlopeStore is used to accumulate vertices for the Y Grid currently being calculated. For each of the X Grids from 1 to 383, there is an entry of 24 bits (sign+13 integer bits+10 fraction bits) for each of 3 colors, containing summed vertices. The X Grid 0 entry contains the final slope calculated from the negative X Grid Vertices, and is 32 bits wide (sign+21 integer bits+10 fraction bits) to avoid overflow during negative X grid calculations. There is also a 27-bit CalcYGridInitVal register (sign+24 integer bits+2 fraction bits) that contains the initial output value for X Grid 0, calculated from the negative X Grid vertices. Total size is 27,753 bits=34,70 bytes.

The AboveYGridSlopeStore value holds the accumulated Horizontal Slopes for the Y Grid above the current active pixel. For each of 384 X Grids, there is a slope entry of 11 bits (sign+10 integer bits) for each of 3 colors. There is also an 18-bit AboveYGridInitVal register (16 integer bits+2 fraction bits) that contains the Initial Output Value for X gGid 0. Total size is 12,690 bits=1,587 bytes. The BelowYGridSlopeStore value holds the accumulated Horizontal Slopes for the Y Grid below the current active pixel. For each of 384 X Grids, there is a slope entry of 11 bits (sign+10 integer bits) for each of 3 colors. There is also an 18-bit BelowYGridInitVal register (16 integer bits+2 fraction bits) that contains the Initial Output Value for X Grid 0. Total size is 12,690 bits=1587 bytes.

The YGrid0SlopeStore is used to accumulate vertices for the first Y Grid of the next frame. For each of the X Grids from 1 to 383, there is an entry of 24 bits (sign+13 integer bits+10 fraction bits) for each of 3 colors, containing summed vertices. The X Grid 0 entry contains the final slope calculated from the negative X Grid vertices, and is 32 bits wide (sign+21 integer bits+10 fraction bits) to avoid overflow during negative X Grid calculations. There is also a 27-bit YGrid0InitVal register (sign+24 integer bits+2 fraction bits) that contains the Initial Output Value for X Grid 0, calculated from the negative X Grid vertices. Total size is 27,753 bits=3,470 bytes.

Grid Slope Interpolation Module 870—

The Grid Slope Interpolation module 870 provides an Output Value for each grid that may be calculated as the sum of all previous slopes, and the difference between the Output Value of a grid, and the Output Value of the next horizontal grid does not need to be calculated because it is the Horizontal Slope.

The problem of encoding the contour shape using this scheme has been introduded and is not insignificant. It is beyond the scope of this document to describe such encoding schemes, but it has been shown that a contour shape of 128×128 grids, which would previously have taken 16K of words can now be encoded in around 1K of words.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

What is claimed is:

1. An apparatus for displaying images comprising:

an LCD panel comprising a plurality of pixels for displaying the images;

a backlight comprising a plurality of light sources, wherein each of the plurality of light sources is associated with one of a plurality of zones and each of the plurality of zones comprises a plurality of grid points; and a controller coupled to the LCD panel and the backlight configured to retrieve contour data associated with each of the plurality of light sources, wherein the contour data is associated with a 3-D contour shape comprising a plurality of facets, each facet associated with at least one of the plurality of grids, and wherein the controller is configured to determine a brightness level of at least one pixel in a first grid based on a slope value associated with a first facet associated with the first grid.

2. The apparatus as set forth in claim 1, wherein the controller is configured to determine a brightness level of the least one pixel in the first grid based on a change in the slope value associated with the first facet.

3. The apparatus as set forth in claim 2, wherein the change in the slope value occurs at a vertex point associated with the first facet.

4. The apparatus as set forth in claim 3, wherein the controller retrieves the contour data from a data table comprising a plurality of vertex points, each vertex point associated with one of the plurality of facets.

5. The apparatus as set forth in claim 1, wherein the controller is further configured to adjust a lighting level of at least one zone to improve a contrast ratio of a displayed image.

6. The apparatus as set forth in claim 5, wherein the controller adjusts the lighting level of the at least one zone by adjusting a lighting level of at least a first light source.

7. The apparatus as set forth in claim 6, wherein the controller adjusts the lighting level of the at least one zone by independently adjusting lighting levels of at least two light sources.

8. The apparatus as set forth in claim 1, wherein the apparatus is configured as a flat panel television.

9. An integrated circuit for use with an LCD panel and a backlight comprising a plurality of light sources, each of the plurality of light sources associated with one of a plurality of zones and each of the plurality of zones comprising a plurality of grid points, wherein the integrated circuit is configured to retrieve contour data associated with each of the plurality of light sources, wherein the contour data is associated with a 3-D contour shape comprising a plurality of facets, each facet associated with at least one of a plurality of grids, and wherein the integrated circuit is configured to determine a brightness level of at least one pixel in a first grid based on a slope value associated with a first facet associated with the first grid.

10. The integrated circuit as set forth in claim 9, wherein the integrated circuit is configured to determine a brightness level of the least one pixel in the first grid based on a change in the slope value associated with the first facet.

11. The integrated circuit as set forth in claim 10, wherein the change in the slope value occurs at a vertex point associated with the first facet.

12. The integrated circuit as set forth in claim 11, wherein the integrated circuit retrieves the contour data from a data table comprising a plurality of vertex points, each vertex point associated with one of the plurality of facets.

13. The integrated circuit as set forth in claim 9, wherein the integrated circuit is further configured to adjust a lighting level of at least one zone to improve a contrast ratio of a displayed image.

14. The integrated circuit as set forth in claim 13, wherein the integrated circuit adjusts the lighting level of the at least one zone by adjusting a lighting level of at least a first light source.

15. The integrated circuit as set forth in claim 14, wherein the integrated circuit adjusts the lighting level of the at least one zone by independently adjusting lighting levels of at least two light sources.

16. For use with an LCD panel, a method for adjusting lighting levels of a backlight of the LCD panel, the backlight comprising a plurality of light sources, each of the plurality of light sources associated with one of a plurality of zones and each of the plurality of zones comprising a plurality of grid points, the method comprising:

retrieving contour data associated with each of the plurality of light sources, wherein the contour data is associated with a 3-D contour shape comprising a plurality of facets, each facet associated with at least one of a plurality of grids; and determining a brightness level of at least one pixel in a first grid based on a slope value associated with a first facet associated with the first grid.

17. The method as set forth in claim 16, wherein determining comprises determining a brightness level of the least one pixel in the first grid based on a change in the slope value associated with the first facet.

18. The method as set forth in claim 17, wherein the change in the slope value occurs at a vertex point associated with the first facet.

19. The method as set forth in claim 18, wherein retrieving comprises retrieving the contour data from a data table comprising a plurality of vertex points, each vertex point associated with one of the plurality of facets.

20. The method as set forth in claim 16, further comprising adjusting a lighting level of at least one zone to improve a contrast ratio of a displayed image.

* * * * *